US010538993B2

(12) United States Patent
Jani

(10) Patent No.: US 10,538,993 B2
(45) Date of Patent: Jan. 21, 2020

(54) APPARATUS AND METHOD FOR PERFORATING A WELLBORE CASING, AND METHOD AND APPARATUS FOR FRACTURING A FORMATION

(71) Applicant: SC Asset Corporation, Calgary (CA)

(72) Inventor: William Jani, Calgary (CA)

(73) Assignee: SC Asset Corporation, Calgary, Alberta ( * ) Notice: Subject to any disclaimer, the term of this patent is extended or adjusted under 35 U.S.C. 154(b) by 178 days.

(21) Appl. No.: 15/470,703

(22) Filed: Mar. 27, 2017

(65) Prior Publication Data

US 2017/0198561 A1 Jul. 13, 2017

Related U.S. Application Data

(63) Continuation of application No. 14/178,056, filed on Feb. 11, 2014, now Pat. No. 10,001,001.

(30) Foreign Application Priority Data

Feb. 10, 2014 (CA) ..... 2842568

(51) Int. Cl.
*E21B 34/14* (2006.01)
*E21B 43/117* (2006.01)
(Continued)

(52) U.S. Cl.
CPC ..... *E21B 34/14* (2013.01); *E21B 23/02* (2013.01); *E21B 31/00* (2013.01); *E21B 34/16* (2013.01);
(Continued)

(58) Field of Classification Search
CPC ..... E21B 23/02; E21B 34/14; E21B 34/007; E21B 43/26; E21B 34/12; E21B 43/117; E21B 34/16; E21B 31/00; E21B 43/263
See application file for complete search history.

(56) References Cited

U.S. PATENT DOCUMENTS 2,749,840 A 6/1956 Babcock
3,656,562 A 4/1972 Baugh
(Continued)

FOREIGN PATENT DOCUMENTS

CA 2850134 A1 4/2013
WO 2011008592 A2 1/2011
WO 2011134069 A1 11/2011

OTHER PUBLICATIONS

Site Oil Tools Ltd.—1981-82 Wireline Production Equipment Catalogue.

*Primary Examiner* — Nicole Coy
(74) *Attorney, Agent, or Firm* — D. Doak Home

(57) ABSTRACT

Apparatus and methods for selectively actuating sliding sleeves in sub members which are placed downhole in a wellbore, to open ports in such sub members to allow fracking of the wellbore, or to detonate explosive charges thereon for perforating a wellbore, or both. A simplified dart and sleeve is used which reduces machining operations on each. The dart is preferably provided with coupling means to permit a retrieval tool to be coupled thereto, which upon the retrieval tool being so coupled allows a bypass valve to operate to assist in withdrawing the dart from within the valve subs. Upward movement of the retrieval tool allows a wedge-shaped member to disengage the dart member from a corresponding sleeve to allow the dart to be withdrawn.

15 Claims, 13 Drawing Sheets

(51) Int. Cl.

| | |
|---|---|
| ***E21B 43/26*** | (2006.01) |
| ***E21B 43/263*** | (2006.01) |
| ***E21B 23/02*** | (2006.01) |
| ***E21B 31/00*** | (2006.01) |
| ***E21B 34/16*** | (2006.01) |
| *E21B 34/00* | (2006.01) |
| *E21B 34/06* | (2006.01) |

(52) U.S. Cl.
CPC ..... *E21B 43/117* (2013.01); *E21B 43/26* (2013.01); *E21B 43/263* (2013.01); *E21B 34/06* (2013.01); *E21B 2034/007* (2013.01)

(56) References Cited

U.S. PATENT DOCUMENTS

| | | | | |
|---|---|---|---|---|
| 4,817,718 | A | 4/1989 | Nelson | |
| 5,449,039 | A | 9/1995 | Hartley et al. | |
| 7,325,617 | B2 | 2/2008 | Murray | |
| 7,441,601 | B2 | 10/2008 | George et al. | |
| 7,552,779 | B2 | 6/2009 | Murray | |
| 8,365,824 | B2 | 2/2013 | Phillips | |
| 8,813,848 | B2 | 8/2014 | Frazier | |
| 9,611,727 | B2 | 4/2017 | Campbell et al. | |
| 9,739,117 | B2 | 8/2017 | Campbell et al. | |
| 2011/0284243 | A1* | 11/2011 | Frazier | E21B 34/063 166/376 |
| 2013/0081827 | A1 | 4/2013 | Etzel | |
| 2013/0112436 | A1 | 5/2013 | Fleming et al. | |
| 2014/0246207 | A1 | 9/2014 | Hofman et al. | |
| 2016/0251923 | A1 | 9/2016 | Keerthivasan et al. | |

* cited by examiner

APPARATUS AND METHOD FOR PERFORATING A WELLBORE CASING, AND METHOD AND APPARATUS FOR FRACTURING A FORMATION

RELATED APPLICATION

This application is a continuation of U.S. Ser. No. 14/178,056 filed Feb. 11, 2014.

FIELD OF THE INVENTION

The present invention relates to apparati and methods for perforating and/or fracturing a wellbore.

BACKGROUND OF THE INVENTION

Of interest to one aspect of the present invention relating to selective opening of ports of a plurality of valve subs within a fracking string to allow fracking of a formation at discrete/selected intervals along a wellbore, prior art designs such as those disclosed in U.S. Pat. No. 6,907,936 (esp. FIG. 1b & FIGS. 3A, 3B), U.S. Pat. No. 6,095,541, US 2006/0124310, and SPE 51177 (September 1998) generally teach a number of valve subs each having a sliding cylindrical sleeve and an associated circular ball seat therein, the slidable sleeve generally covering a frac port to keep it closed when the sleeve is in a first (closed position), and the sleeve may be moved to a second (open) position which uncovers the frac port to allow frac fluid to be supplied through a pre-perforated casing to thereby fracture the formation. The ball seat for each slidable sleeve reduces in diameter for each sleeve of an associated valve sub the further downhole the valve sub is placed.

In operation, to progressively open frac ports within each of the valve subs, a first ball of small diameter is injected downhole and flows past larger diameter ball seats in associated valve subs [thereby leaving the slidable sleeve therein in a position covering the frac ports] until the most downhole sleeve is reached having the smallest diameter ball seat, which ball seat is smaller in diameter than the first ball. The first ball's further downhole motion is thus arrested by the smaller-diameter ball seat, and fluid pressure uphole of the ball forces the first ball, the ball seat, and associated slidable sleeve to move downhole, thereby uncovering and thus opening the frac port within the most downhole valve sub. Fluid under pressure is continued to be injected and pumped down the wellbore to frac the formation in the location of the open port in such wellbore. Thereafter, a second ball, of slightly larger diameter, is injected downhole, which second ball is larger in diameter than the ball seat as contained in the second-lowermost (downhole) valve sub. Now the second ball's further downhole motion is thus arrested by the smaller-diameter ball seat, and fluid pressure uphole of the second ball forces the first ball, the ball seat, and associated slidable sleeve to move downhole, thereby uncovering and thus opening the frac port within the second most downhole valve sub.

The above process is repeated, using progressively larger diameter balls, until all of the slidable sleeves in each of the valve subs has been opened, and the formation fractured in the region of the open frac ports of each of the valve subs.

Thereafter, a milling sub is passed through the bore of each of the valve subs to mill out and thereby remove each of the balls and ball seats, to thereby allow hydrocarbons flowing into the valve sub to be freely pumped up to surface.

Such prior art method and apparati possess at least two distinct disadvantages.

Firstly, one shortcoming of the ball valve seat mechanisms as described above is that such mechanism cannot be cemented into place within a casing due to the fact there is no way to then clean or wipe the cement out of the ball seat mechanism for subsequent use. Such prior art systems thus typically need to be used with a liner with open hole packers, which adds to the cost.

A second disadvantage is that due to the progressively decreasing diameter of the ball seat in each of the valve subs, the volume and rate of fracking fluid flow is thus seriously and undesirably restricted in the most downhole regions of the wellbore, and typically a flow rate of 15 cubic meters per minute [with wellbores of the typical 6-9 inch (15-23 cm) diameter] cannot be obtained.

A further disadvantage of the "graduated size ball drop" mechanisms of the prior art is that due to the need to have a plurality of balls of different (but distinct) diameters, the number of valve subs can typically be no greater than 23 stages, and thus typically no more than 23 areas along a wellbore can be fracked at a single time, unless one or more ball seats incorporate a release mechanism such as that disclosed in U.S. Pat. No. 4,893,678 (i.e. a "kickover" mechanism) to allow the ball to pass through the associated ball seat after having actuated the sliding sleeve to open the associated port, to allow additional one or more downhole subs to have their respective frac ports opened by the same valve.

In order to overcome the above disadvantages with the prior art graduated-size ball drop mechanisms and methods, US2013/0168098 (CA2,797,821) (having a common inventor to the present invention) teaches in one embodiment a dart 22, as shown in FIGS. 7-9 thereof, having "keys" 42, which keys 42 only engage the keyways 32 of a corresponding valve sub 10 (ref. FIG. 5 and para. [009], [0039], with the keys 42 becoming progressively wider with each successive valve sub 10 disposed in well casing 49 towards the top of well 46. Finer graduations in dart key width and corresponding sleeve groove width can be implanted, and in doing so, it was postulated in such application that the number of valve subs in a single casing string could be increased to something in the range of 16 to 30 or more.

Notably, however, the keyways in such configuration run longitudinally of the valve sub, and are not circumferential, as is clear from FIG. 6 thereof.

In an alternative configuration shown in FIGS. 12A-15 of US 2013/0168098, a dart 22 (ref. FIG. 14 thereof) is provided, having a key profile 54 which is biased towards the inner wall of sliding piston (sleeve) 20 (ref. para. [0044]. When the key profile 58 on a particular dart 22 matches a key profile on piston 20 within a particular valve sub 10, the keyways engage and the piston 20 is caused to move. Specifically, as noted at para [0048], in such embodiment dart 22 can travel through casing 49 until it reaches a matching key profile 54, where it then latches into piston 20 and locking shoulder 56. The top of dart cup 44 on dart 22 can form a seal within valve body 12, and shear pins 25 are then caused to shear under fluid pressure exerted on dart 22 which causes engaged piston 20 to move down the well, to thereby open ports 14, which can then supply fluid pressure to the formation at such location. FIGS. 15a, 15B, 15C, 15D show a series of possible key profiles 54 and dart profiles 58 for such embodiment. Notably, however, all of such profiles teach a plurality of grooves in the interior surface of piston (sleeve) 20, with the "keying" dependent on the relative number and spacing of the grooves relative to each other to provide the selective "keying" arrangement.

Disadvantageously, while such above design of US2013/0168098/CA2,797,821 eliminates the problem of reduced bore diameter and consequent restriction of flow of fluid, such as fracking fluid and moreover further increases the number of possible valve subs which can be used due to the infinite number of "key" combinations using different numbers and relative spacing between the circumferential grooves formed on the inner wall of piston 20 which form the key profile 54 [ref. para. 0044], machining of piston/sleeve 20 and darts 22 in the manner disclosed in US2013/0168098 becomes unduly time consuming and expensive.

Accordingly, a simpler manner of allowing a selected dart to locate and engage a respective desired piston/sleeve 20 is thereby needed, to reduce machining costs.

As regards perforating a casing of a well to allow egress of frac fluid from the wellbore to thereby frac the well, in the prior art the casing perforation step is typically accomplished by lowering a series of discrete explosive charges within a wellbore, separated by known distances to perforate the well at desired distances of separation. After perforation such perforating "guns" then need to be removed from the wellbore before associated valve subs can be introduced for the separate fracking operation.

A real benefit would be realized if an apparatus or method could be developed which did not require separate insertion and removal of perforating guns downhole.

Moreover, a real advantage would further be realized if not only could apparatus or a method be developed that did not require separate insertion and removal of perforating guns, but further if such casing perforating step could form part of a fracking operation, and in particular form part of a frac string and associated valve subs, and be able to perforate the casing at the same time and at the same location along the wellbore as the particular fracking of the well occurs.

This background information is provided for the purpose of making known information believed by the applicant to be of possible relevance to the present invention. No admission is necessarily intended, nor should be construed, that any of the preceding information, or the reference in the drawings to "prior art" constitutes prior art against the present invention.

SUMMARY OF THE INVENTION

This summary does not necessarily describe the entire scope of the present invention. Other aspects, features and advantages of the invention will be apparent to those of ordinary skill in the art upon a proper review of the entire description of the invention as a whole, including the drawings and consideration of the specific embodiments of the invention described in the detailed description.

In one aspect of the present invention it is an object to provide a simpler apparatus and method for using a dart to selectively open frac ports on various valve subs within a wellbore to frac a formation along a wellbore in such formation, but which does not have the machining complexity and requires less machining operations than does the creation of the particular key profiles on each of the dart and piston (sleeve) as disclosed in US 2013/0168098.

It is a further object of the present invention to incorporate casing perforation means within fracking apparatus, to avoid the time and expense of having to use separate apparatus for performing the casing perforation step as opposed to the fracking operation when completing a well for production.

In a first broad aspect of the invention such invention comprises valve subs and associated darts which are of a novel configuration which requires little machining of both darts and sleeves, but nonetheless allows a dart to be unique from other darts and the associated sleeves to likewise by unique from other sleeves, and still allows each dart to s be able to actuate only a desired selected sleeve and thus open a frac port in only a selected (desired) valve sub.

In a first refinement of such broad aspect a single circumferential groove is machined on the interior surface of each slidable sleeve for the associated valve subs, the width of each circumferential groove in each slidable sleeve being different and unique. Associated darts, having a radially-outwardly biased member thereon of an associated width, may then be used to "locate" a particular dart within a particular desired sleeve so as to thusly uniquely actuate such desired sleeve to open a frac port in such desired valve sub.

Accordingly, in such refinement an apparatus for placement in a wellbore for fracturing an underground formation along said wellbore is provided, such apparatus comprising:

(i) a plurality of hollow cylindrical valve sub members for placement in said wellbore, each having coupling means at opposite ends thereof for physically coupling said valve sub members together in an end-to-end relation, each having a bore of similar diameter and at least one frac port extending through each of said valve sub members proximate an uphole end thereof;

(ii) a hollow cylindrical slidable sleeve within each of said valve sub members, longitudinally slidable within said bore thereof, said slidable sleeve closing said at least one port when said sleeve is in a first closed position and opening said port so as to allow said port to be in fluid communication with said bore when said slidable sleeve is longitudinally positioned downhole to a second open position, said sleeve initially maintained in said first closed position by shear means; and (iii) a single circumferential groove in an interior surface of said slidable sleeve within each of said valve sub members, said single grooves of a width for receiving therewithin a radially-outwardly biased member of corresponding width on a dart positioned within said bore to allow said dart to slidably reposition a sliding sleeve of a valve sub from said first position to said second position.

In one embodiment thereof, the circumferential grooves in said slidable sleeves are each of a different width relative to each other, said width progressively decreasing for each valve sub positioned downhole, with each uphole valve sub having a slidable sleeve with a cylindrical groove of a lesser width than the cylindrical groove within a slidable sleeve within an adjacent downhole valve sub, to allow displacement of selective of said slidable sleeves from said first position to said second position by a plurality of darts having radially-outwardly biased members of a corresponding width.

In an alternative embodiment, where it is desired to open, using a single dart, a number of valve subs substantially simultaneously, the circumferential groove in a slidable sleeve within an uphole cylindrical member is of the same width as a cylindrical groove of a slidable sleeve within an adjacently coupled downhole cylindrical member; and said uphole cylindrical member and/or said adjacently coupled downhole cylindrical member further having a contact surface for depressing inwardly said radially-outwardly biased member on said dart member when said uphole slidable sleeve has repositioned to said second open position, so as to permit said dart to be disengaged from said uphole slidable sleeve within said uphole cylindrical member and thereafter continue to progress downhole for further engagement with one or more slidable sleeves of downhole cylindrical members.

In a further refinement of the invention, the dart is provided with a mechanism, activated by a retrieving tool, to allow it to be removed from engagement with a sliding sleeve of an associated valve sub, to allow the dart, once it has served its purpose of activating an associated sleeve to move such sleeve from the first position to the second position, to be removed from the valve sub and from the wellbore. Accordingly, in such embodiment, the apparatus further comprises coupling means on said dart at an uphole end thereof for permitting coupling of said dart to a retrieving tool; and a longitudinally moveable wedge-shaped member on said dart, wherein when said retrieving tool is coupled to said dart and thus to said wedge-shaped member and said retrieving tool is withdrawn for a short distance uphole, said withdrawal longitudinally repositions said wedge-shaped member uphole which then depresses said radially-outwardly-biased member to allow disengagement thereof with said groove to thereby allow said dart to be withdrawn uphole.

The invention further comprises a method for using the apparatus as described above for fracking a well.

Accordingly, in one aspect of the invention for fracking a well using the apparatus described above, a method for inserting valve subs within a wellbore and progressively, from downhole to uphole, opening frac ports therein using a plurality of darts and further fracturing said formation is disclosed, such method comprising the steps of:

(i) inserting a hollow slidable sleeve having a single circumferential groove of width $W_1$ on an interior surface thereof, within a bore of a first cylindrical hollow valve sub, said first valve sub having a frac port proximate an uphole end thereof;

(ii) applying a shear means on said first cylindrical hollow valve sub to retain said slidable sleeve in a first closed position preventing fluid communication from an exterior of said first valve sub to said bore;

(iii) inserting a hollow slidable sleeve having a circumferential groove of width $W_2$ on an interior surface thereof, within a bore of a second cylindrical hollow valve sub, said second valve sub having a frac port proximate an uphole end thereof, where $W_2<W_1$;

(iv) applying shear means on said second valve sub to retain said sleeve in a first closed position denying fluid communication from an exterior of said second valve sub to said bore;

(v) lowering said valve subs into said wellbore with said first valve sub positioned below said second valve sub, to position frac ports thereon at desired locations along said wellbore;

(vi) injecting a first dart downhole into said bore of said valve subs, said first dart having a radially-outwardly biased member of width less than or equal to $W_1$ but greater than $W_2$;

(vii) after said first dart and said radially-outwardly biased member thereon has engaged said groove in said slidable sleeve in said first valve sub, providing fluid pressure to said valve subs so as to cause said slidable sleeve in said first valve sub to be slidably longitudinally repositioned in said first valve sub to a second open position wherein said slidable sleeve in said first valve sub no longer covers said frac port therein;

(viii) continuing to supply fluid pressure to said first valve sub to thereby supply said fluid to said formation via said frac port on said first valve sub to thereby frac the formation at such location along the wellbore;

(ix) injecting a second dart downhole into said bore of said valve subs, said second dart having a radially-outwardly biased member of width less than or equal to $W_2$;

(x) after said second dart and said radially-outwardly biased member thereon has engaged said groove of width $W_2$ in said slidable sleeve in said second valve sub, providing fluid pressure to said valve subs so as to cause said slidable sleeve in said second valve sub to be slidably repositioned in said second valve sub to a second open position wherein said slidable sleeve no longer covers said frac port therein; and (xi) continuing to supply fluid pressure to said second valve sub to thereby supply said fluid to said formation via said frac port on said second valve sub to thereby frac the formation at such further location along the wellbore.

In a second refinement of the above apparatus for fracking a well, which accomplishes the same result as the first refinement but in a different manner, a single circumferential groove is instead alternatively machined on the exterior surface of each dart, the width of each circumferential groove in each dart being different and unique. The various sleeves in each valve sub are each provided with a radially-inwardly biased member thereon of an associated width, may then be used to "locate" a particular dart within a particular desired sleeve so as to thusly uniquely actuate the sleeve to open a frac port in a desired valve sub.

Accordingly, in such alternative refinement of the above apparatus, the invention comprises an apparatus for placement in a wellbore for fracturing an underground formation in a region along said wellbore, comprising:

(i) a plurality of hollow cylindrical valve subs for placement in said wellbore, each having a bore of similar diameter and at least one port extending through each of said valve subs proximate an uphole end thereof;

(ii) a hollow cylindrical slidable sleeve within each of said valve subs, longitudinally slidable within said bore thereof, said slidable sleeve closing said at least one port when said sleeve is in a first closed position and opening said port so as to allow said port to be in fluid communication with said bore when said slidable sleeve is displaced downhole along said bore to a second open position, said sleeve initially maintained in said first closed position by shear means fixing said slidable sleeve to said bore in said first open position; and (iii) a radially-inwardly biased member on each of said slidable sleeves for engaging a corresponding single circumferential groove in an exterior surface of a cylindrical dart positioned within said bore;

wherein said radially-inwardly biased member on said slidable sleeve within each uphole valve sub is of a greater width than the radially-inwardly biased member on a slidable sleeve within each adjacent downhole valve sub.

The invention further comprises a method using the apparatus of the above alternative embodiment for fracking a well. Accordingly, in such further (alternative) method for inserting valve subs within a wellbore and progressively opening frac ports therein using a plurality of darts so as to frac the formation along the wellbore, such alternative method comprises the steps of:

(i) inserting a hollow slidable sleeve, having a radially-inwardly biased member of width $W_1$ on an interior surface thereof, within a bore of a first cylindrical hollow valve sub, said first valve sub having a frac port proximate an uphole end thereof;

(ii) applying shear means on said first valve sub to retain said slidable sleeve therein in a first closed position preventing fluid communication from an exterior of said valve sub to said bore;

(iii) inserting a hollow slidable sleeve, having a radially-inwardly biased member of width $W_2$ on an interior surface thereof, where $W_2>W_1$, within bore of a second cylindrical hollow valve sub, said second valve sub having a frac port proximate an uphole end thereof;

(iv) applying a shear means on said second valve sub to retain said slidable sleeve therein in a first closed position denying fluid communication from an exterior of said valve sub to said bore;

(v) lowering said coupled valve subs into said wellbore with said first valve sub downhole of said second valve sub, to position frac ports thereon at desired locations along said wellbore;

(vi) injecting a first cylindrical dart downhole into said bore of said valve subs, said first dart having a single circumferential groove about an outer circumference thereof of width greater than or equal to $W_1$ but less than $W_2$;

(vii) after said first radially-inwardly biased member on said slidable sleeve in said first valve sub has engaged said groove in said first dart member, providing fluid pressure to said valve subs so as to cause said slidable sleeve in said first valve sub to be slidably longitudinally repositioned downhole in said first valve sub to a second open position wherein said slidable sleeve no longer covers said frac port therein;

(viii) continuing to supply fluid pressure to said first valve sub to thereby supply said fluid to said formation via said frac port on said first valve sub to thereby frac the formation at such location along the wellbore;

(ix) injecting a second cylindrical dart downhole into said bore of said valve subs, said second dart having a single circumferential groove of width greater than or equal to $W_2$ about an outer circumference thereof;

(x) after said radially-inwardly biased member on said slidable sleeve in said second valve sub has engaged said groove in said second dart, providing fluid pressure to said valve subs so as to cause said slidable sleeve in said second valve sub to be slidably longitudinally repositioned downhole in said second valve sub to a second open position wherein said slidable sleeve no longer covers said frac port therein; and (xi) continuing to supply fluid pressure to said second valve sub to thereby supply said fluid to said formation via said frac port on said second valve sub to thereby frac the formation at such further location along the wellbore.

In another broad aspect of the present invention, apparatus for perforating a well casing is disclosed. In a broad aspect, such apparatus for perforating a wellbore casing when inserted in a wellbore surrounded by said casing comprises:

(i) a hollow cylindrical sub member for placement in said wellbore casing, having coupling means at opposite ends thereof and having an inner bore;

(ii) a hollow cylindrical slidable sleeve within said sub member, longitudinally slidable within said bore of said sub member from a first uphole position therein to a second downhole position therein;

(iii) a shear member which initially fixes said slidable sleeve to said bore and maintains said slidable sleeve in said first position;

(iv) a directional shaped explosive charge within or on a portion of an exterior of said slidable sleeve or said sub member; and (v) actuation means for actuating said directional shaped explosive charge upon slidable displacement of said sleeve from said first position to said second position.

In a preferred embodiment/refinement, a cylindrical dart is provided for insertion in said bore, having engaging means thereon for engaging said slidable sleeve and causing longitudinal downhole slidable movement of said slidable sleeve when fluid pressure is exerted at an uphole end of said dart.

In one further refinedment, the engaging means on said dart comprises a radially-outwardly biased member, said slidable sleeve having a single circumferential groove in an interior surface thereof of sufficient width for receiving therewithin said radially-outwardly biased member.

In an alternative refinement, the engaging means on said dart comprises a single circumferential groove in an exterior surface thereof, said slidable sleeve having a radial-inwardly biased member, said radially-inwardly biased member of sufficient width for receiving therewithin said radially-inwardly biased member.

In a preferred refinement of each of the alternative embodiments, the dart further possesses, at an uphole end thereof, latch means to permit coupling to a retrieval tool, to permit said dart to be withdrawn from said wellbore.

In a still further refinement where the dart is adapted to be capable of being disengaged from the associated sleeve and withdrawn from the wellbore, in similar fashion to the manner of adapting the dart to be removed from valve subs used in a fracking operation, when a dart is used in a perforating operation it too may be likewise modified to provide for removal. In such embodiment a longitudinally moveable wedge-shaped member is provided on the dart. When the retrieval tool is coupled to said dart and thus to said wedge-shaped member and said retrieving tool is withdrawn for a short distance uphole, said withdrawal longitudinally repositions said wedge-shaped member uphole which then depresses said radially-outwardly-biased member to allow disengagement thereof with said groove to thereby allow said dart to be withdrawn uphole.

Regardless of whether the dart is used for actuating a sliding sleeve to open a frac port or to actuate an explosive charge in an associated sub, the darts will generally be provided with a seal means such as a cup seal thereon to assist, when fluid pressure is applied thereto, in pushing the dart through the bore and sliding the sliding sleeve. However, when removing the dart from the wellbore and drawing it uphole, fluid above the dart makes it difficult to remove the dart from the well without swabbing the entire distance of wellbore uphole of the dart due to the seal (cup seal). Also, without a bypass which may be opened when removing the dart from the well, it frequently is difficult to remove the dart from within the wellbore due to a created suction.

Accordingly, in a refinement of the apparatus of the invention, either for use in fracking a well, or perforating a well, or both, where it is desired to remove the dart, and where as is typical the dart possesses seal means thereon, the dart is further provided with a bypass port situated uphole from said cup seal to allow fluid above said cup seal to bypass said cup seal when said dart is withdrawn uphole and prevent swabbing of such well when such dart is withdrawn; and the dart having a valve member sleeve covering said bypass port, which valve member is adapted to be displaced by said retrieval tool when said retrieval tool is coupled to said dart to thereby open said bypass port.

In a preferred embodiment of the sub used to perforate a casing of a wellbore, the ability to frac the wellbore at the same time is further provided. Accordingly, in a preferred embodiment, such sub member of the perforating apparatus is further provided with at least one frac port extending therethrough proximate an uphole end thereof, with the slidable sleeve closing said at least one frac port when said sleeve is in said first uphole position and opening said port so as to allow said port to be in fluid communication with said bore when said slidable sleeve is longitudinally displaced to said second downhole position.

In a preferred embodiment, the directional shaped explosive charge is positioned on the slidable sleeve immediately beneath said frac port when said slidable sleeve is displaced to said second downhole position. This allows the explosive charge to direct its energy, upon detonation, through the (now open) frac port, and immediately perforated the casing in the precise location immediately above the frac port, which is the precise and best location in the casing for the perforation to be located for optimum and most expedient fracting of the formation, and draining of hydrocarbons into the wellbore.

Alternatively, the directional shaped explosive charge may be positioned on an exterior of said sub member immediately proximate the frac port thereon, to thereby provide perforation of the wellbore casing in the immediate vicinity of the frac port.

In one embodiment, the actuation means for detonating the explosive charges in each of the subs comprises a battery for supplying an electrical voltage, and said slidable sleeve upon moving to said second downhole position contacts and thus closes an electrical circuit in communication with said battery and the charge to allow said voltage to be supplied to said shaped charge to detonate said shaped charge.

In another embodiment, the actuation means comprises a mechanical percussion pin member within said slidable sleeve, and wherein said percussion pin member is moved when said slidable sleeve is displaced to said second position and thereby caused to contact and ignite said shaped explosive charge on said slidable sleeve.

Accordingly, in another aspect of the invention, the invention comprises a method for perforating a casing of a wellbore, comprising the steps of:

(i) inserting a hollow cylindrical sub member in said wellbore casing, said sub member having:
  (a) coupling means at opposite ends thereof and an inner bore;
  (b) a hollow cylindrical slidable sleeve within said sub member, longitudinally slidable within said bore of said sub member from a first uphole position to a second downhole position;
  (c) shear means which initially fixes said slidable sleeve to said bore and maintains said slidable sleeve in said first position;
  (d) a directional shaped explosive charge within or on a portion of an exterior of said slidable sleeve or said sub member; and
  (e) actuation means for actuating said directional shaped explosive charge upon and at the time of said slidable sleeve being displaced from said first position to said second position;

(ii) inserting a dart in said bore of said cylindrical member, said dart having engaging means thereon for engaging said slidable sleeve and causing downhole slidable movement of said slidable sleeve when fluid pressure is applied to said dart to said second position; and (iii) providing fluid pressure at an uphole end of said dart and causing said slidable sleeve to move from said first uphole position to said second position.

In addition for disclosing an apparatus for advantageously both perforating and fracking a wellbore with a single "string", the present invention provides a method for doing same using the apparatus as disclosed herein.

Accordingly, in such further greatly preferred refinement, the above method may further be modified to advantageously both perforate and frack a wellbore with a single "string". In such method the sub member further comprises at least one frac port within said sub member situated proximate an uphole end thereof; and the method further comprises the step of applying fluid pressure at said uphole end of said dart and causing said slidable sleeve to move from said first uphole position to said second downhole position to simultaneously detonate said shaped charge and open said frac port.

BRIEF DESCRIPTION OF THE DRAWINGS

FIG. 4A shows an uphole sleeve, and a dart used for actuating a downhole sleeve, bypassing said uphole sleeve. FIG. 4B shows the same dart of FIG. 4A entering a bore of a downhole valve sub and sleeve. FIG. 4C shows the same dart engaging the downhole sleeve of FIG. 4B. FIG. 4D shows the dart having engaged the sleeve of FIG. 4C, and having moved the sleeve to the second (open) position to thereby open the frac port of the associated valve sub;

In FIG. 7A, the individual dart is a dart selected for actuating a downhole sleeve, and accordingly is shown bypassing an uphole sleeve which is incapable of engagins such dart so as to be actuated thereby. FIG. 7B shows a different dart, adapted to actuate the upper sleeve. FIG. 7C shows the same dart of FIG. 7B being engaged by the sleeve of FIG. 7B. FIG. 7D shows the dart of FIG. 7C having actuated the sleeve and thereby opened the respective frac port;

FIG. 9A shows the dart with the 1 inch locator engaging the associated sleeve. FIG. 9B shows the dart actuating the sleeve and opening the frac port. FIG. 9C shows a retrieval tool being coupled to the dart and moving a sleeve to open the bypass valve. FIG. 9D shows the wedge-shaped member being actuated when the retrieval tool draws the dart uphole and the wedge-shaped member thereby disengaging the dart from the associated sleeve;

FIG. 16A shows the dart about to pass through an uphole sleeve and associated valve sub while moving downhole towards a downhole valve sub. FIG. 16B shows the same dart engaging the downhole sleeve in the downhole sub. FIG. 16C shows the sleeve of such downhole sub moved to the second position and thereby simultaneously detonating the explosive charge to perforate the casing and open the frac port at such location along the wellbore.

DETAILED DESCRIPTION OF PREFERRED EMBODIMENTS

Figure 1A:
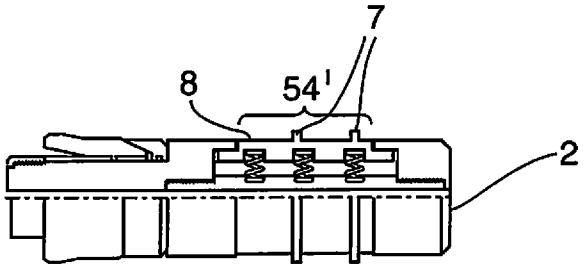
Fig. 1A ( Prior Art )
FIG. 1A is a fanciful illustration of a dart member disclosed in US 2013/0168098/CA 2,797,821/WO 2011/134069 for the purpose of illustrating is manner of operation, such dart having at least two raised ridges which are radially outwardly biased and separated, as between different darts, by a variable distance to providing a unique profile.

FIG. 1A shows a dart 2 of the type disclosed in US 2013/0168098 for insertion in valve subs 3*a*, 3*b*, simplified somewhat in the key profile 54' over the thereof but nonetheless illustrative of the manner by which dart 2 and corresponding key profile 54' thereon is selective to permit same to be "keyed" into a particular sliding sleeve 4*b* within valve sub 3*b* in order to open a particular frac port 5*b* within valve sub 3*b*.

Figure 1B:
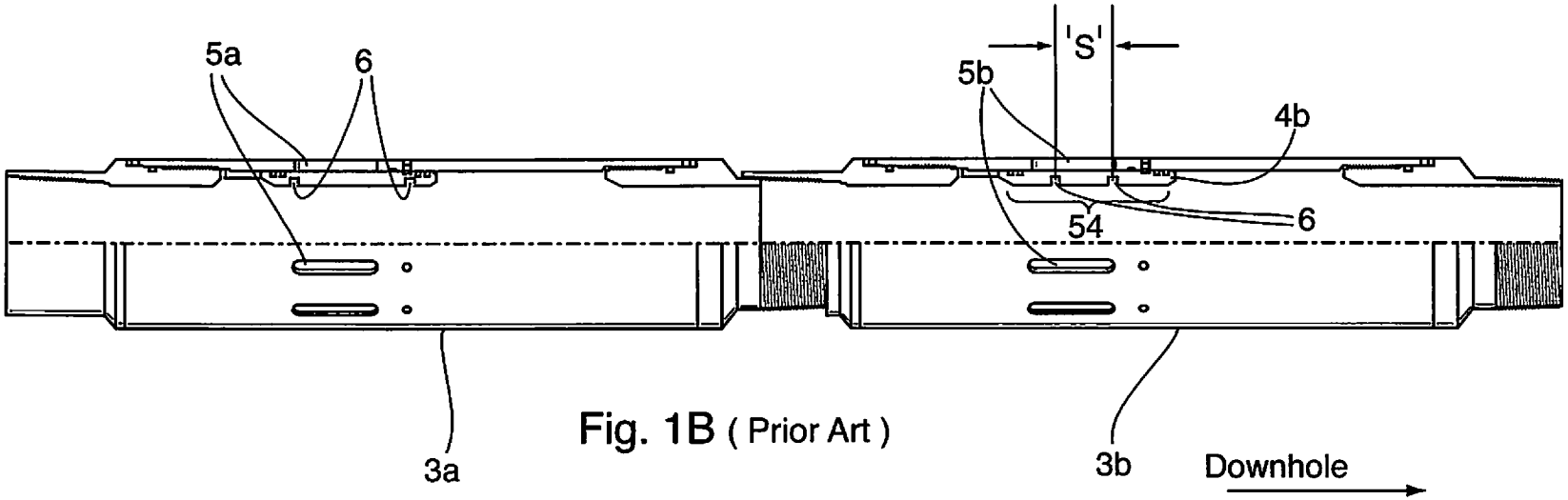
Fig. 1B ( Prior Art )
FIG. 1B is a fanciful illustration of a pair of coupled valve sub members as disclosed in US 2013/0168098, for the purpose of illustrating the manner of operation, each slidable sleeve having at least two circumferential grooves which are separated, as between different slidable sleeves, by a variable distance 'S' to thereby provide a unique profile for each sleeve for engaging, and being actuated by, a unique dart having a corresponding (albeit inverse) profile.

As seen from FIG. 1B, each of sliding sleeves 4*a*, 4*b* are provided with a plurality of circumferential grooves 6 which form a unique key profile 54 within each of respective sleeves 4*a*, 4*b*. A corresponding (inverse) unique key profile 54' comprising a series of raised ridges 7 is likewise provided on a radially-outwardly biased member 8 on dart 2 (ref. FIG. 1A).

An integral feature of key profile 54 which allows the individual circumferential grooves 6 in each sleeve 4*a*, 4*b* to be a unique profile is the width of the spacing "S" between the individual circumferential grooves 6 (ref. FIG. 1B). This allows dart 2 to be "keyed" into a corresponding sleeve 4*b* of valve sub 3*b*, as opposed to "keying" into sleeve 4*a* and thus being unable to "key" into sleeve 4*b*.

Disadvantageously the creation of a plurality of circumferential grooves 6, of different unique spacing "S" therebetween, as well as the corresponding plurality of ridges 7 on dart 2, requires considerable machining time. A simpler and less machining-intensive apparatus and method to allow a sleeve 4*a*, 4*b* to be selectively actuated by a given dart 2 is needed.

The present invention, in each of its various apparati and methods, achieves such objective, and will now be described.

Figure 2B:
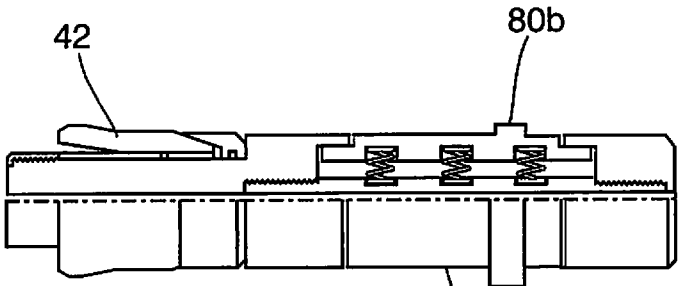
FIGS. 2A and 2B are illustrations of one embodiment of the dart of the present invention wherein the dart is provided with only a single, radially-outwardly biased member, which as between darts is of a different width.
Figure 2A:
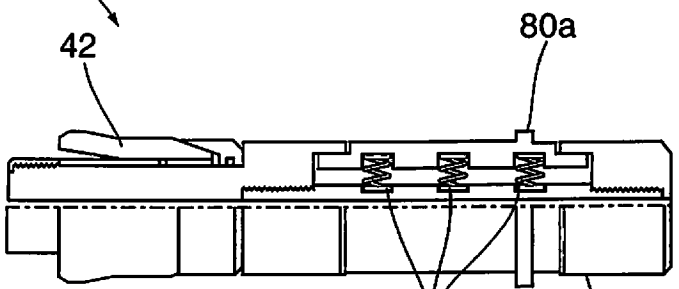
Figure 3:
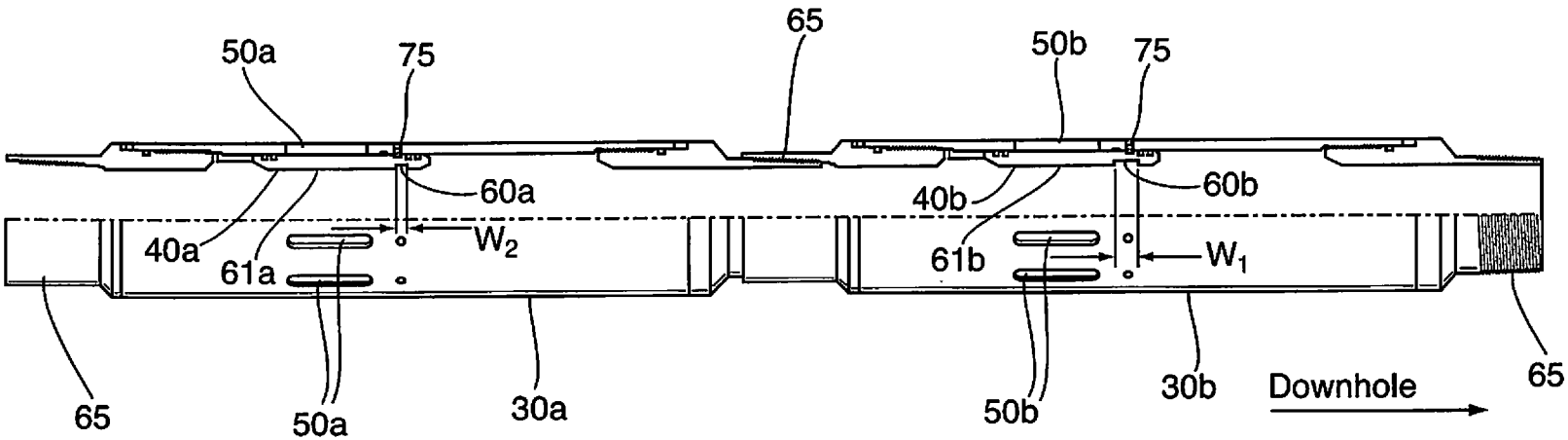
FIG. 3 is an illustration of a pair of coupled valve sub members of the present invention (not to scale) for the purpose of illustrating is manner of operation of one embodiment of the present invention, each slidable sleeve having only one circumferential groove, each of a different and unique width, to thereby provide a unique profile for each sleeve for engaging, and being actuated by, a unique dart.

FIGS. 2A, 2B, & FIG. 3 illustrate one embodiment of the apparatus of the present invention 10. Such embodiment includes darts 20*a*, 20*b*, each having a seal means thereon such as a cup seal 42 as shown, and valve subs 30*a*, 30*b*, and illustrates a method by which such apparatus may be employed. Particular apparatus 10 allows for simplified and less time consuming machining of sleeves 40*a*, 40*b* for valve subs 30*a*, 30*b* and of darts 20*a*, 20*b* themselves, but which nonetheless allows effective selection and actuation of sleeves 40*a* and/or 40*b* in the manner hereinafter described to open respective frac ports 50*a*, 50*b* in respective valve subs 30*a*, 30*b*.

The apparatus of the present invention, in one embodiment and as shown in FIGS. 2A-9D and FIG. 15A-C is intended for use in a fracking operation where fluid is injected along a wellbore within a formation to create fissures in the formation and thus assist in providing flow channels within the formation to allow hydrocarbons to flow therealong and into the wellbore to thereby be collections. In such embodiment of the present invention 10 the apparatus to accomplish such task comprises a plurality of hollow cylindrical valve subs, for example valve subs 30*a*, 30*b*, which each have coupling means 65 at opposite ends thereof to allow them to be physically coupled together in an end-to-end relation. Such valve subs 30*a*, 30*b* are adapted for insertion down a wellbore (not shown). The wellbore may be a vertical wellbore or a deviated horizontal wellbore, as is now frequently common.

Figures 4A, 4B, 4C, 4D:
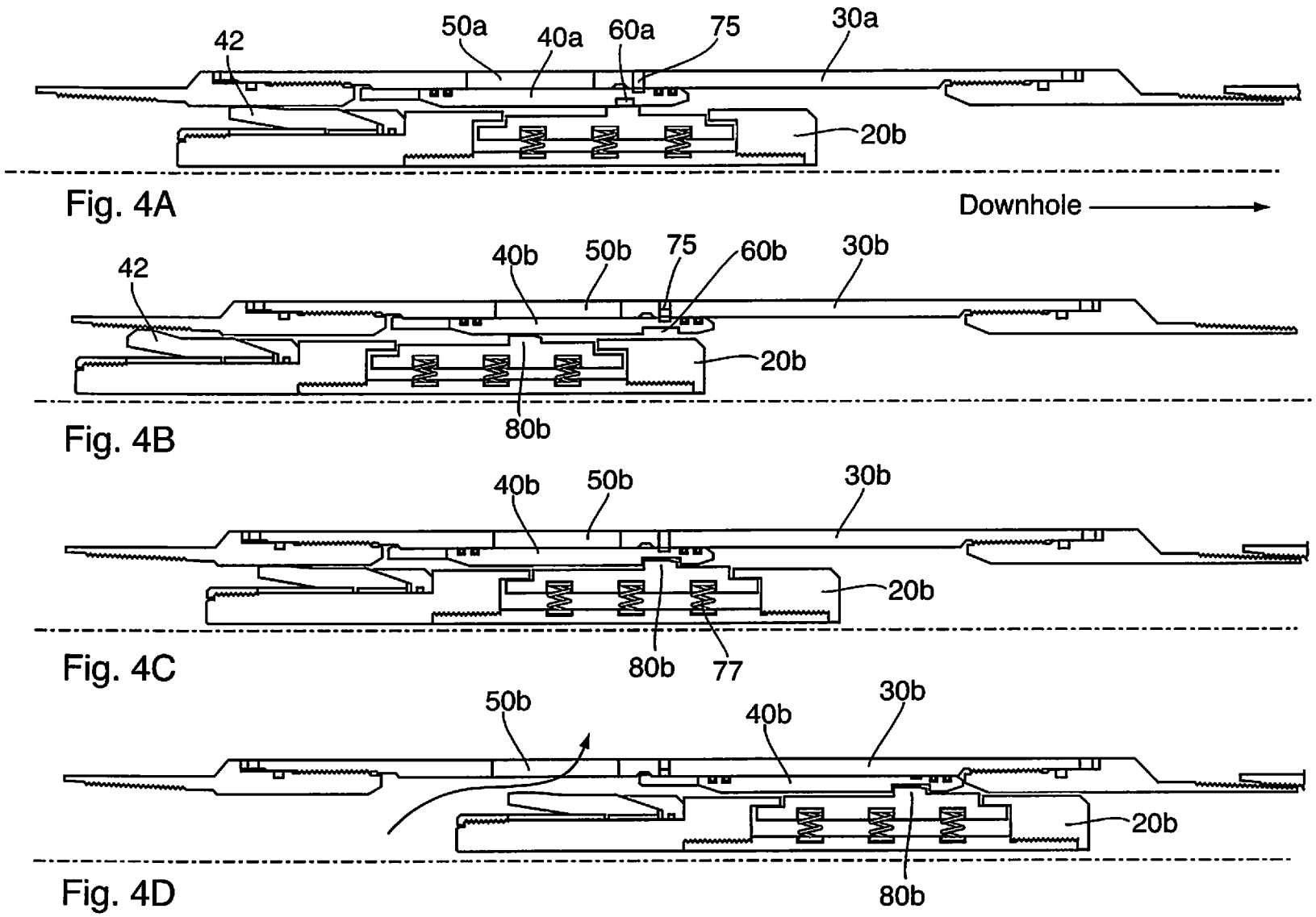
FIGS. 4A-4D show a method of the present invention using the apparatus of the present invention shown in FIGS. 2A, 2B, and FIG. 3.
Figure 5:
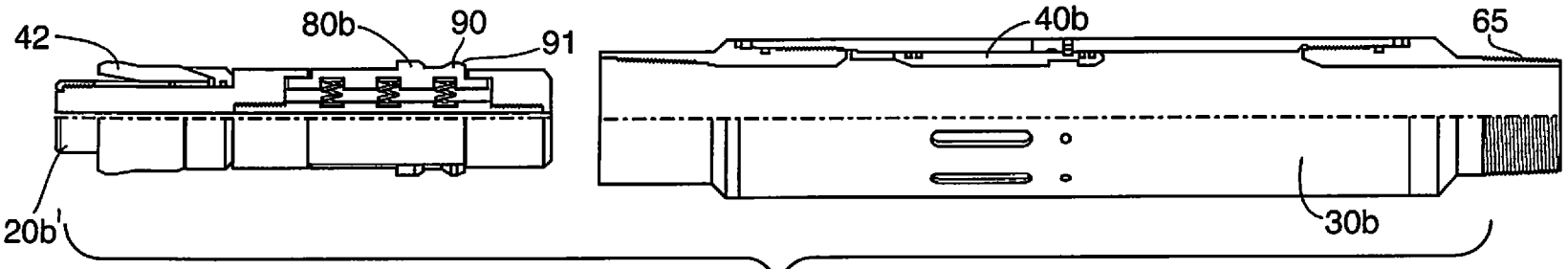
FIG. 5 shows another embodiment of the apparatus of the present invention for fracing a well, showing a dart and a valve sub and sleeve incorporating a modification to allow "kickover" of a single dart to allow such single dart subsequently move downhole to further actuate a plurality of sleeves and thereby open a plurality of frac ports in a corresponding plurality of valve subs.
Figure 6A:
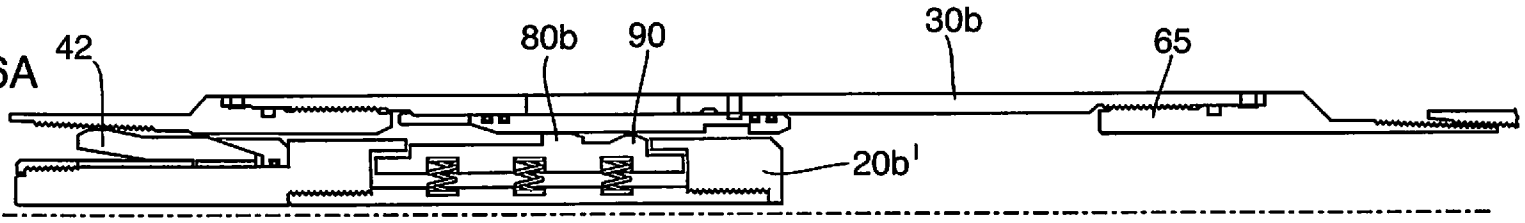
FIGS. 6A-FIG. 6D show the manner of operation of the dart and valve sub in FIG. 5, and how the dart and valve sub progressively act, in such embodiment, the dart to "kick over" to a further downhole valve sub, such dart in FIG. 6C being shown to have opened the frac port of the associated valve sub, and being in the process of being dis-engaged from its associated sleeve to permit the dart to continue to then pass downhole to similarly engage one or more downhole sleeves and thereby cause such one or more sleeves to open the associated valve port, and in FIG. 6D such dart is shown to be finally engaged with a downhole sleeve and to have actuated such sleeve to thereby open the associated port.
Figure 6B:
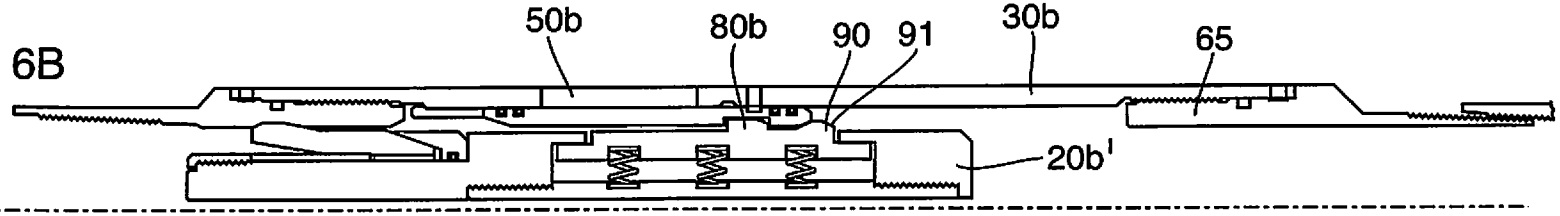
Figure 6C:
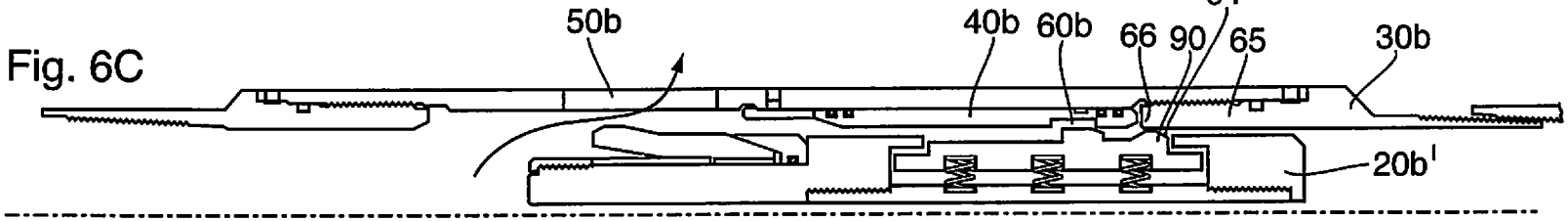
Figure 6D:
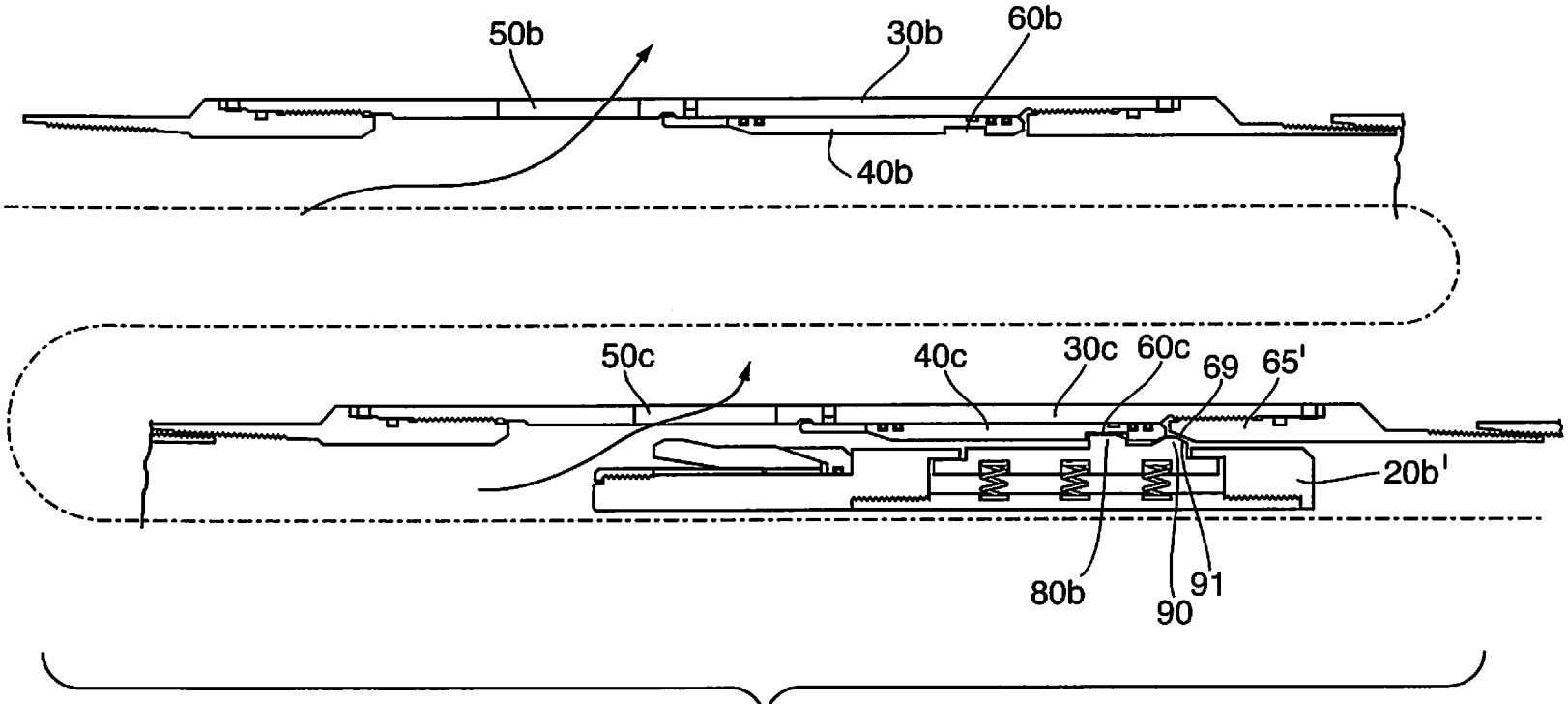
Figure 7A:
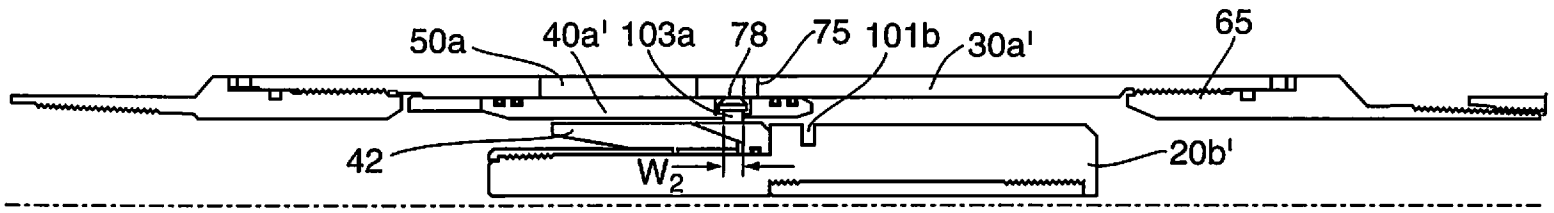
FIGS. 7A-7D show a dart and sleeve of the present invention in a different embodiment, employing a different method and apparati, wherein the dart is provided with a circumferential groove, and the sleeves are provided with a radially-inwardly biased member, with each dart having a circumferential groove of a different and unique width, and only engageable by a particular sleeve having a radially-inwardly biased member of an equal or lesser width.
Figure 7B:
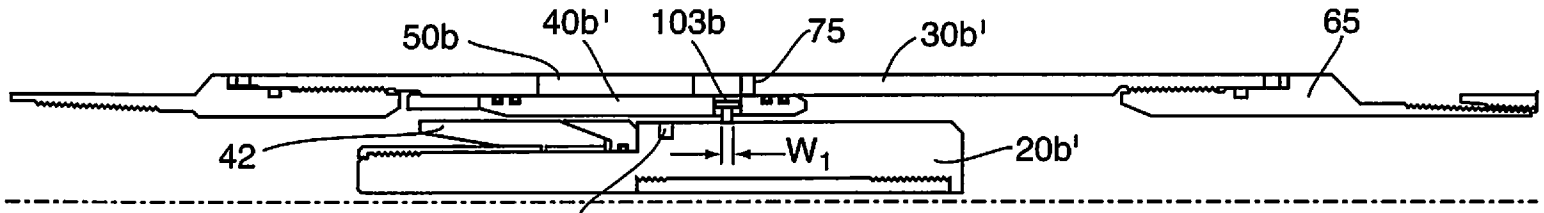
Figure 7C:
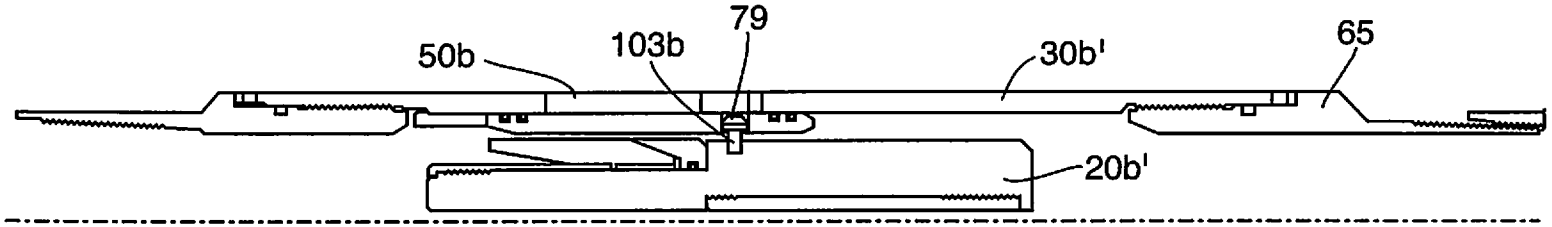
Figure 7D:
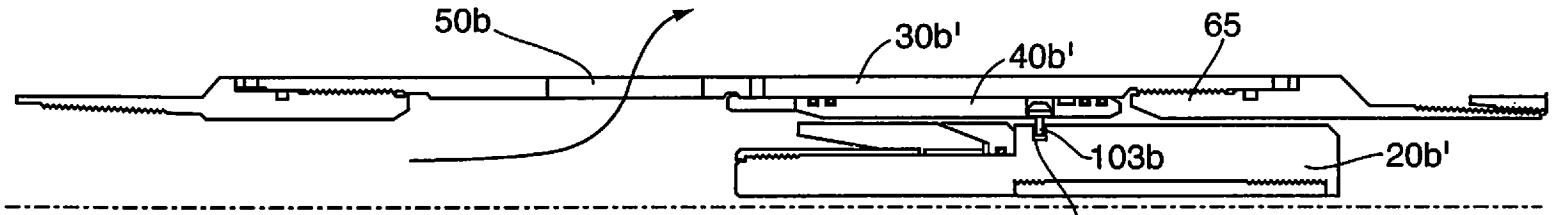
Figure 8:
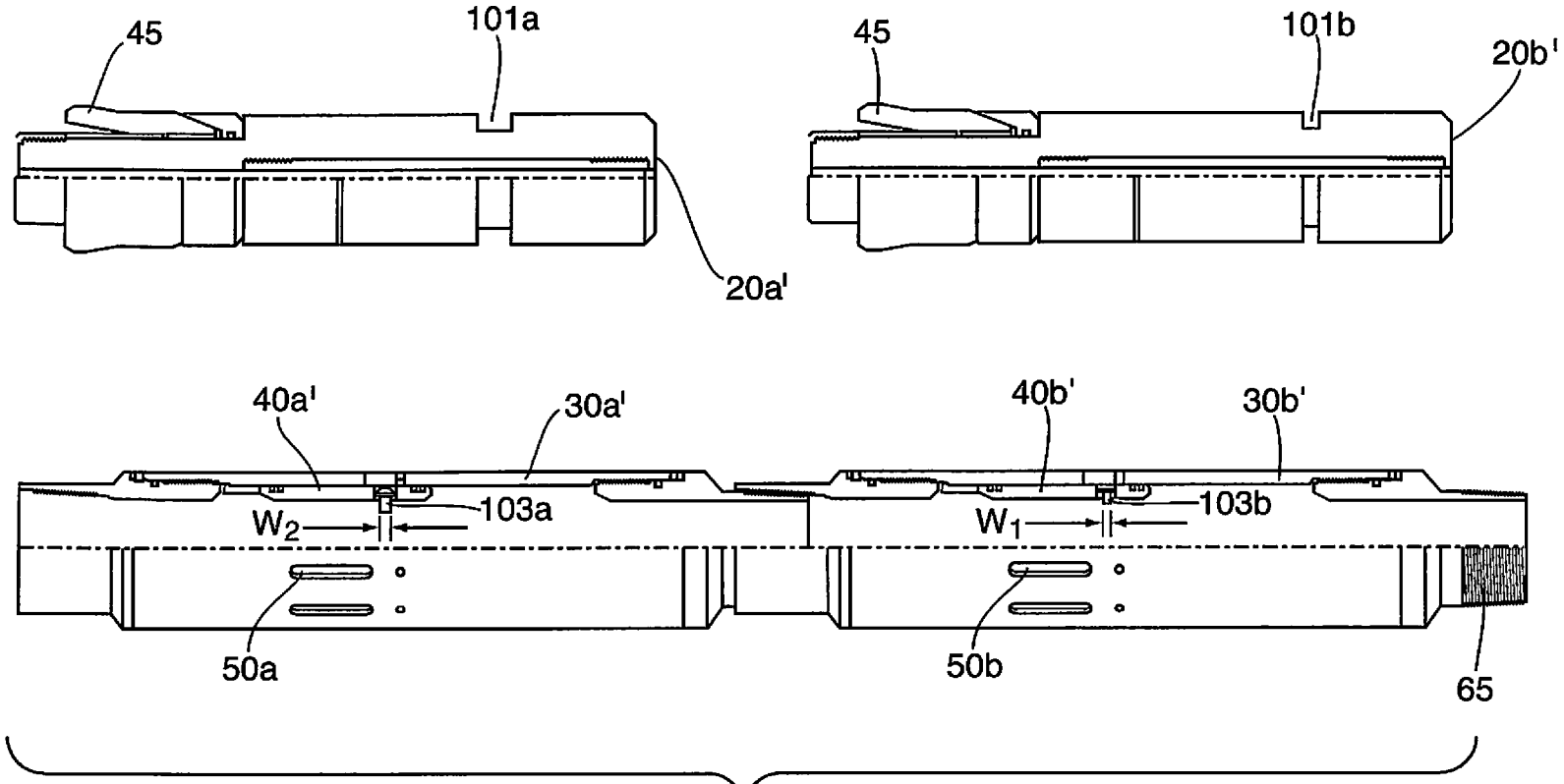
FIG. 8 shows in greater detail the individually each of the modified series of darts and modified sleeves used in the method of FIG. 7A-7D.

Each of valve subs 30*a*, 30*b* are typically provided with corresponding frac ports 50*a*, 50*b* which are opened when a corresponding hollow slildable sleeve 40*a*, 40*b* within a respective corresponding valve subs 30*a*, 30*b* moves (when actuated by a corresponding dart 20*a*, 20*b*) from a first position (as shown in FIG. 3) where such frac ports 50*a*, 50*b* are covered by sleeves 40*a*, 40*b* and thus closed, to an open second position, wherein sleeves 40*a*, 40*b* have been slidably repositioned by a dart 20*a*, 20*b* respectively to such second position, as shown for example in FIGS. 4D, 6D, & 7D. A shear means, typically a shear pin or set screw 75, is provided to initially retain each of sleeves 40*a*, 40*b*, within respective valve subs 30*a*, 30*b* in the first position covering respective frac ports 50*a*, 50*b*. Shear pin/set screw 75 is adapted to shear when respective darts 20*a*, 20*b*, actuated by fluid pressure engage a respective sleeve 40*a*, 40*b*, and causes such sleeve 40*a*, 40*b* to be slidably displaced downhole to the second position, where frac ports 50*a*, 50*b* are uncovered and are thus open.

Integral to this embodiment of the invention 10 is the provision of a single circumferential groove 60*a*, 60*b* in an interior surface 61*a*, 61*b* of each of respective slidable sleeves 40*a*, 40*b* (best shown in FIG. 3), and the provision of a radially-outwardly biased member 80*a*, 80*b* on respective darts 20*a*, 20*b* (see FIGS. 2A, 2B). Width $W_1$ of circumferential groove 60*b* on slidable sleeve 40*b* is of a different (i.e. greater) width than the width $W_2$ of circumferential groove 60*a* on slidable sleeve 40*a*, with any grooves within valve subs uphole from sleeve 40*a* having progressively narrower widths than groove 60*a*, and similarly any grooves in valve subs situated downhole from groove 60*b* having progressively greater widths the more downhole the corresponding valve sub is positioned in relation to other valve subs.

Complementary to the above feature, unique darts 20*a*, 20*b* are correspondingly adapted to actuate respectively, slidably sleeves 40*a*, 40*b*, by each being provided with a radially-outwardly biased member 80*a*, 80*b* of a respective width adapted to allow mating engagement with corresponding circumferential/radial groove 60*a*, 60*b*. In such manner, by inserting a dart with a radially-outwardly biased member of greatest width, such dart will bypass valve sub 20*a*, and only engage the sleeve contained in the most downhole valve sub. Thereafter, in similar fashion, additional darts having radially-outwardly biased members of progressively lesser widths, can be successively injected downhole, to actuate respective sleeves in progressively further and further uphole valve subs, until all sleeves have been progressively opened and the wellbore progressively fracked in a manner from downhole to uphole. Radially-outwardly biased members 80*a*, 80*b* may be radially-biased outwardly by any known means such as by leaf springs or a plurality of helical coil springs 77, as shown in FIGS. 2A, 2B, and FIGS. 4A-4D, for example.

FIGS. 4A-4D show the above apparatus and method of actuating downhole valve sub 30*b* within a fracking string positioned in a well to as to commence progressively frac a wellbore, commencing in the location of valve sub 30*b*.

FIG. 4A shows dart 20*b*, intended to actuate downole sleeve 40*b* in downhole valve sub 30*b*, moving past sleeve 40*a* without actuating it.

FIG. 4B shows dart 20*b* moving downhole in the direction of valve sub 30*b* and circumferential groove 60*b* in sleeve 40*b*.

FIG. 4C shows radially-outwardly biased member 80*b* on dart 20*b* engaging circumferential groove 60*b* on slidable sleeve 40*b*.

FIG. 4D shows shear pins 75 having sheared, and consequently slidable sleeve 40*b* having moved to the second position in valve sub 30*b*, thereby opening port 50*b* and allowing fluid to flow outwardly therefrom to frac the formation at such location along the wellbore.

In a refinement of the above apparatus and method, it is occasionally desired to simultaneously open a number of adjacent valve subs within a frack string comprised of a plurality of valve subs, to allow simultaneous fracking of the formation along a given length of the wellbore.

Accordingly, in such further refinement and as shown in FIG. 5 and FIGS. 6A-6D, further modifications may be made to a particular dart 20*b*' and to the coupling means 65' coupling various valve subs 30*b*, 30*c* together, to allow such dart to actuate not only valve sub 30*b*, but to be "kicked over" in the manner hereinafter described, to become disengaged from sleeve 40*b* of valve sub 30*b*, and to flow downhole to further actuate another downhole sub 30*c*.

Specifically in this refinement, and with reference to FIG. 5 and FIGS. 6A-6D, dart 20*b*' may be provided with an upwardly protruding (and radially-outwardly biased) member 90. Protruding Member 90 serves, when dart 20*b*' has slidably displaced sleeve 40*b* in valve sub 30*b* to the second position, to contact and engage contact surface 66 (see FIG. 6C) on coupling means 65, thereby causing both radially-outwardly biased member 80*b* and protruding member 90 with inclined face 91 thereon to move radially inwardly and thereby out of engagement with circumferential groove 60*b*, and thus permit dart 20*b*' to pass further downhole to within a further downhole valve sub 30*c* as shown in FIG. 6D.

Upon reaching downhole sub 30*c* and engaging circumferential groove 60*c* (of same width as circumferential groove 60*b*) on slidable sleeve 40*c* and causing slidable sleeve 40*c* to move to the second position thereby opening frac port 50*c*, further "kick-over" of dart 20*b*' may be prevented by eliminating contact surface 66 on coupling means 65' and providing a milled region 69 thereon, as shown in FIG. 6D. Radially-outwardly biased member 80*b* is thereby prevented from being depressed, thereby preventing dart 20*b* from becoming disengaged from corresponding sleeve 40*b*. The wellbore may now be fracked at locations of each of valve subs 30*b* & 30*c* via respective (open) ports 50*b*, 50*c* therein.

FIGS. 7A-7D and FIG. 8, show another embodiment of the method and apparatus of the present invention, wherein instead of having a radially-outwardly biased member 80*a*, 80*b* on dart 20*a*, 20*b* respectively wherein biased members 80*a*, 80*b* are of different widths in contrast a radially-inwardly biased member 103*a*, 103*b* are provided within respective sleeves 40*a*', 40*b*', which are of different widths $W_2$, $W_1$ respectively, with the width $W_2$ radially-inwardly biased member 103*a* being greater than the width $W_1$ of radially-inwardly biased member 103*b*. Biased members 103*a*, 103*b* are biased radially inwardly by a respective spring member 78, 79.

Corresponding to the alternate configuration of the sleeves 40*a*', 40*b*', modified darts 20*a*', 20*b*' each having respectively a single circumferential groove 101*a*, 101*b*, where the width of groove 101*a* is approximately equal to or slightly greater than the width $W_2$ of radially-inwardly biased member 103*a*, both of which are greater than the width $W_1$ of radially-inwardly biased member 103*b* in downhole sleeve 40*b*'. Likewise, the width of groove 101*b* in downhole dart 20*b*' is approximately equal to or slightly greater than the width or radially-inwardly biased member 103*b*, but such is less than the width of either radially-inwardly biased uphole member(s) 103*a* or groove 101*a* in dart 20*a*'.

In such manner radially-inwardly biased members 103*a*, 103*b* are especially adapted to matingly engage respective circumferential groove 101*a*, 101*b* on respective darts 20*a*', 20*b*', to allow actuation of respective valve subs 30*a*', 30*b*'.

In operation, FIG. 7A shows dart 20*b*' moving downhole past sleeve 40*a*', which it fails to engage due to groove 101*b* thereon being narrower than radially-inwardly biased member 103*a*.

FIG. 7B shows dart 20*b*' moving downhole to actuate valve sub 30*b*' and in particular sleeve 40*b*'.

FIG. 7C shows radially-inwardly biased member 103*b* engaging groove 101*b* in dart 20*b*'.

FIG. 7D shows sleeve 40*b*' after having been slidably displaced downhole by dart 20*b*', and port 50*b* thereby having been opened.

FIG. 9A-9D show another embodiment of the invention wherein a dart 20 may be withdrawn after having actuated a sleeve 40 in a valve sub 30, and progressively shows, in FIG. 9A through FIG. 9D, the progressive series of steps to accomplish same.

In such embodiment as may be seen from FIGS. 9A-9D the darts 20*a*, 20*b* (in this example simply dart 20) is further configured with coupling means 120 to allow coupling at an uphole end 121 thereof to a retrieval tool 130. A longitudinally moveable wedge-shaped member 140 is provided on dart 20, at a downhole end thereof. Such wedge-shaped member 140, when retrieving tool 130 is withdrawn a short distance uphole (see FIG. 9C, 9D), repositions wedge-shaped member 140, having frusto-conical surface 141 thereon, thereby allowing frusto-conical surface 141 to depresses radially-outwardly biased member 80, and in particular protruding member 90 and inclined face 91 on dart 20, to allow disengagement of radially-outwardly biased member 80 and thus dart 20 with sleeve 40, and allow dart 20 to be withdrawn uphole.

Due to the presence of cup seal 45 on dart 20 when removing the dart 20 from the wellbore and drawing it uphole, fluid above dart 20 makes it difficult to remove the dart 20 from the well without swabbing the entire distance of wellbore uphole of the dart 20.

Figures 9A, 9B, 9C, 9D:
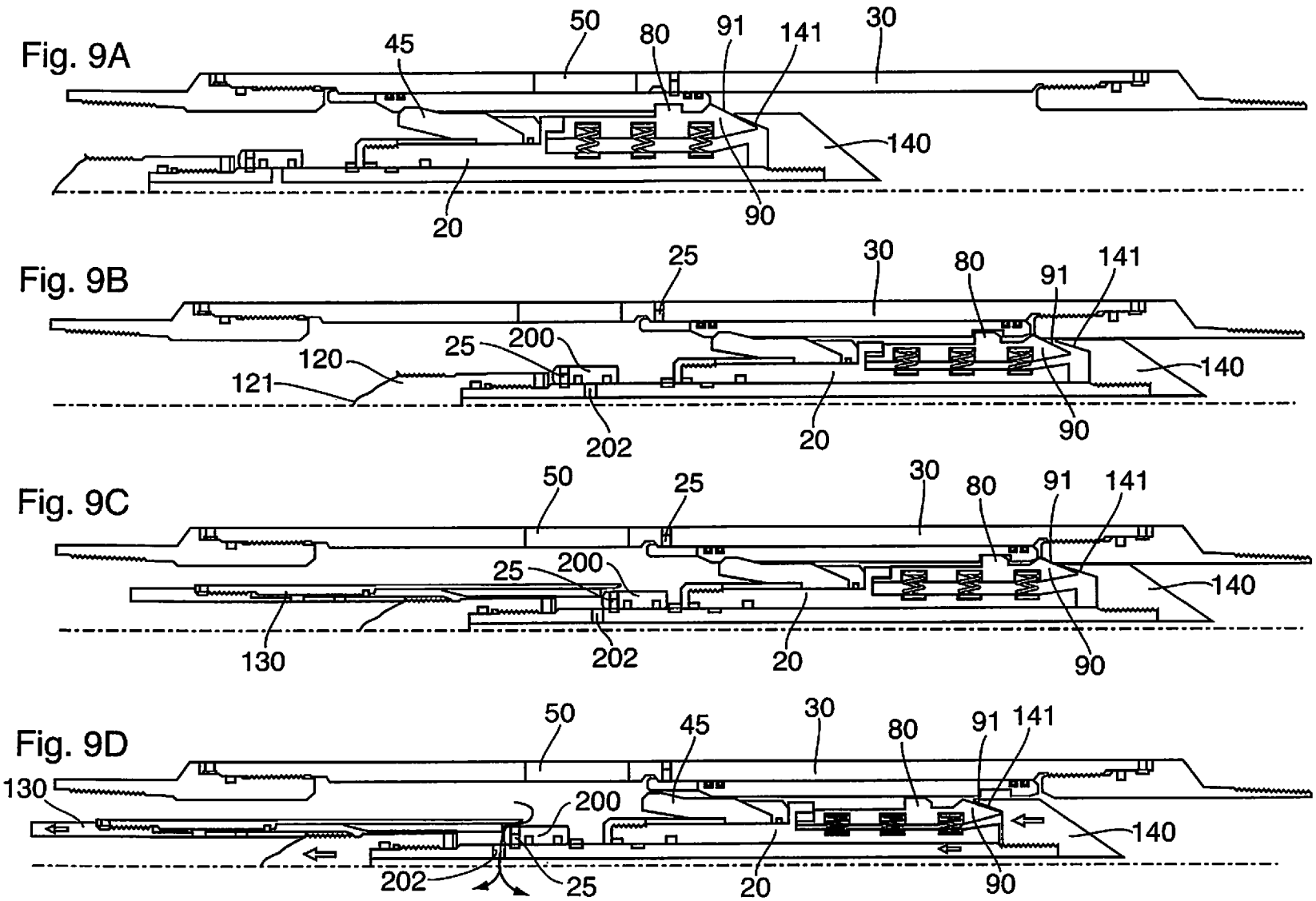
FIGS. 9A-9D show a dart and sleeve as per the embodiment thereof shown in FIGS. 4-6D, but with the dart having coupling means thereon to permit removal by a retrieval tool, and further having a bypass port which is opened by the retrieval tool when coupled to the dart, to allow bypass of fluids past the cup seal on the dart, to allow the dart to be drawn up the well, the dart further having a wedge-shaped member to allow disengagement of the dart with the associated sleeve to allow the dart to then be drawn uphole. The dart and sleeve are provided with a 1 inch (2.54 cm) "locator".
Figures 10A, 10B, 10C, 10D:
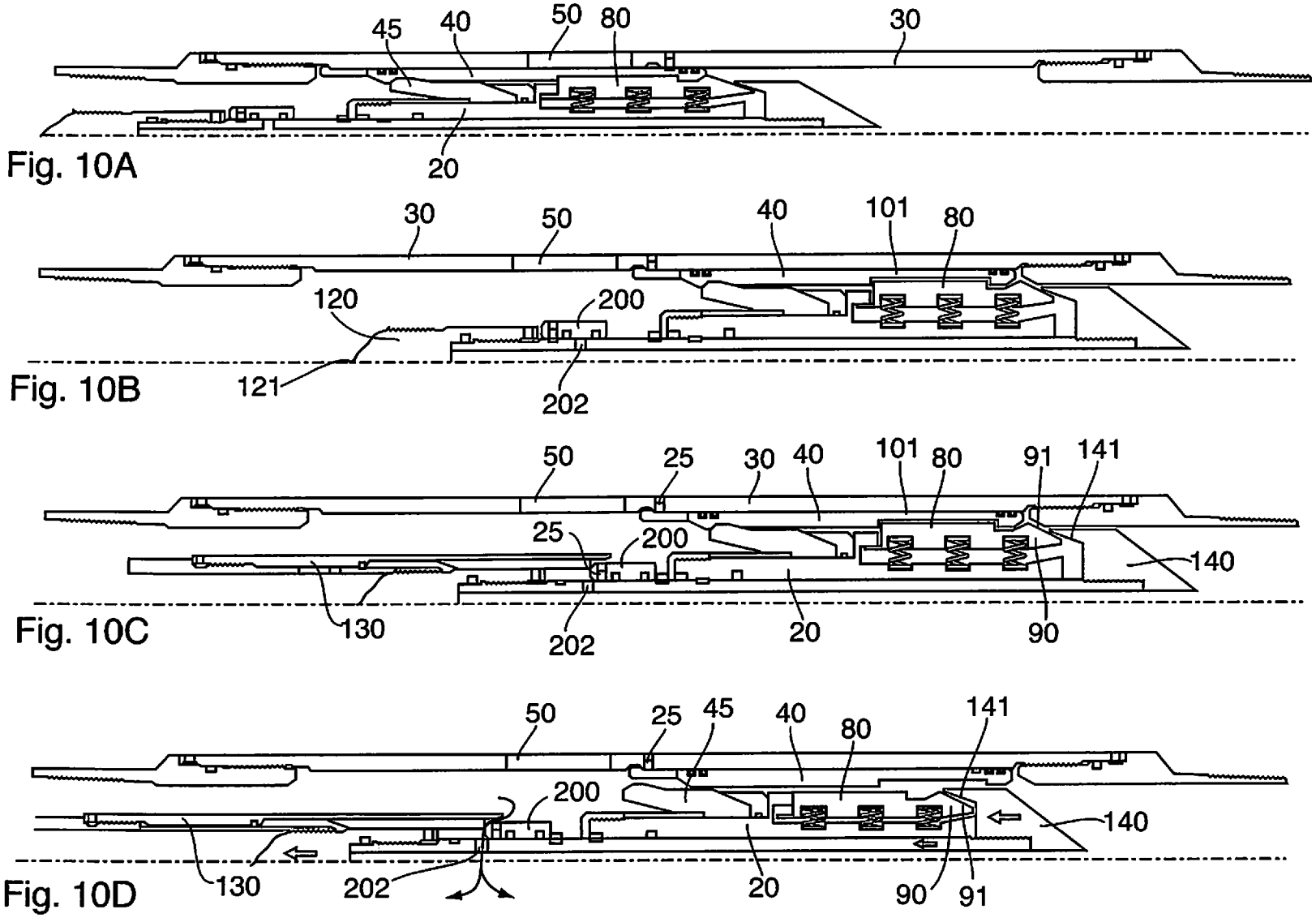
FIGS. 10A-10D show a dart and sleeve similar to the views shown in FIGS. 9A-9D, but instead provided with a 4 inch (10 cm) locator circumferential groove on the sleeve, and a similar 4 inch radially-outwardly biased member on the dart.

Accordingly, in a refinement of the apparatus of the invention, also shown in FIG. 9A-9D, either for use in fracking a well, or perforating a well, or both, where it is desired to remove the dart 20, and where as is typical the dart 20 possesses seal means 45 thereon, dart 20 is further provided with a bypass port 202 situated uphole from said cup seal 45 to allow fluid above said cup seal 45 to bypass said cup seal 45 when dart 20 is withdrawn uphole. Dart 20 is further provided with a moveble valve sleeve 200, initially covering bypass port 202 and secured by shear pin 25. Valve sleeve 200 is adapted to be slidably displaced by retrieval tool 130, when retrieval tool 130 is coupled to dart 20 to thereby open bypass port 200, as shown in FIG. 9C, 9D.

FIGS. 10A-10D show a similar embodiment of the dart 20 as shown in FIGS. 9A-9D, save and except that radially-outwardly biased member 80 in FIGS. 9A-9D is a 1 inch (2.54 cm) width, whereas radially outwardly biased member 80 in FIGS. 10A-10D shows actuation of a more downhole valve sub, and dart 20 consequently possesses a wider [4 inch (10.1 cm)] radially-outwardly biased member 80, and circumferential groove 101 in sleeve 30 is also correspondingly wider.

FIGS. 11-16C show another aspect of the present invention.

Specifically, FIGS. 11-14 teach a perforating sub member 300 which is further provided with an explosive charge 302 useful for perforating a cement liner of a wellbore, or steel wellbore casing, in preparation for a subsequent fracking operation.

The explosive charge 302 to be employed is preferably a directional shaped explosive charge. Explosive charge 302 may be situated within a milled area 303 on the exterior of perforating sub member 300, as shown in FIGS. 11-14, when such explosive charge is adapted to be electrically actuated, or alternatively may be situated on a milled area on the exterior of slidable sleeves 20*a*, 20*b* as shown in FIG. 15 and FIGS. 16A-16D, when such charge 302 is desired to be electrically actuated via a battery 405 (ref. FIGS. 11-14 and 16A-16D), or mechanically actuated such as by using a percussion pin 404, as shown in FIG. 15.

Figure 11:
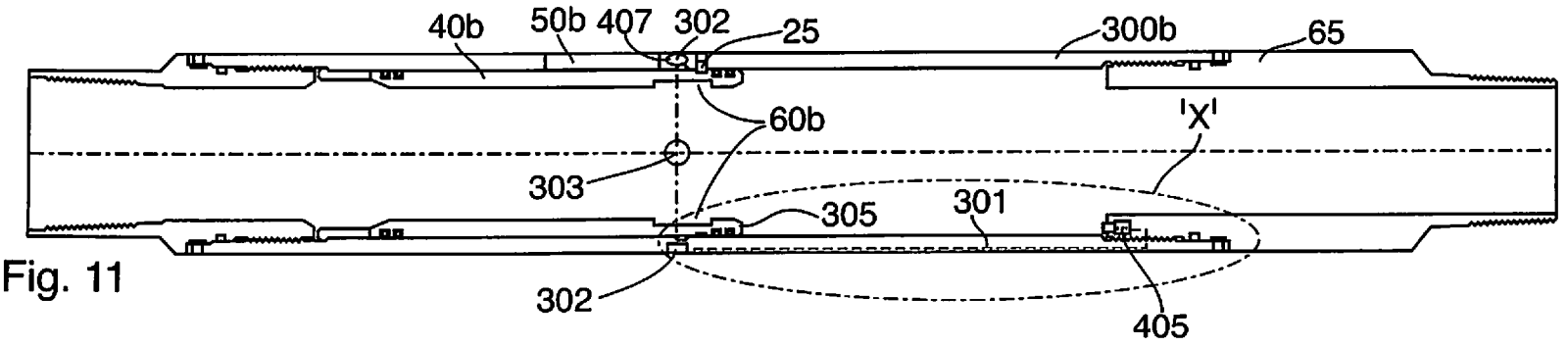
FIG. 11 shows a sub member of the present invention, in one embodiment thereof, for perforating a well casing, with the sleeve shown in the first position.
Figure 12:
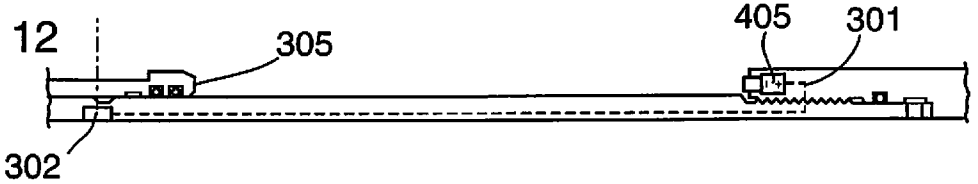
FIG. 12 shows an enlargement of area 'X' of FIG. 11.

FIGS. 11-14 teach a sub member 300*b* having a corresponding slidable sleeve 40*b*, which is initially secured in place in a first position, as shown in FIG. 11, via a shear pin 25. Slidable sleeve 40*b* is provided with a circumferential groove 60*b*, which is adapted to engage a radially-outwardly biased member 80*b* on a dart 20*b*.

In the embodiment shown in FIGS. 11-14, sleeve 40*b* is provided on an exterior surface thereof, in a region proximate a frac port 50*b* thereon, with an explosive charge 302 in a milled region 303. An electrical contact 305 is provided at an extremity thereof. A battery 405 may be provided within sub member 300*b* or within an adjacent sub member, with electrically conductive lines 301 running within or on the exterior of sub member 300*b* back to explosive charge 302.

Figure 13:
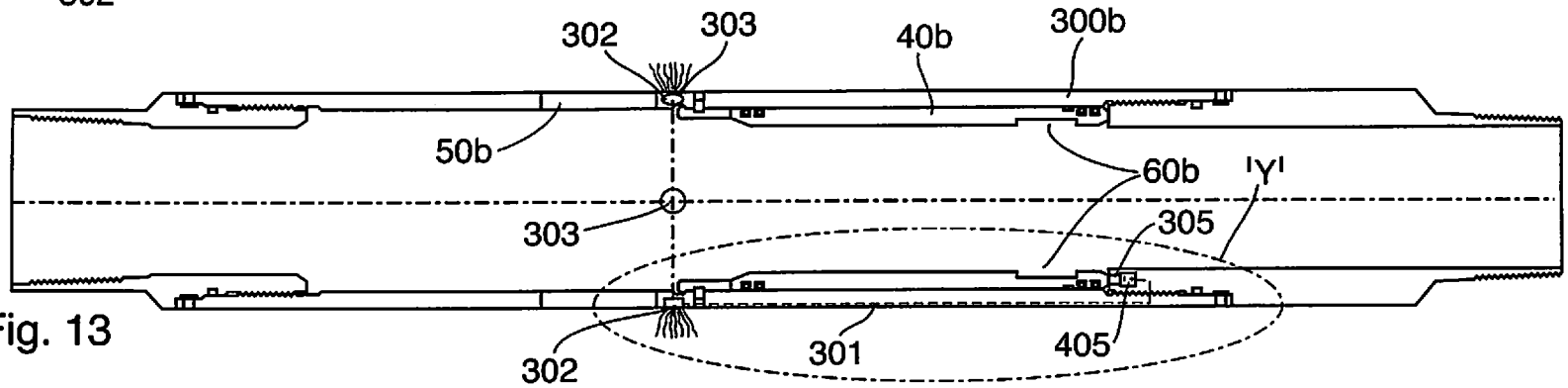
FIG. 13 shows the sub member of FIG. 11, with the sleeve having been displaced to the second position in which it closes an electrical circuit to supply voltage from a battery to a shaped charge to then perforate the casing.
Figure 14:
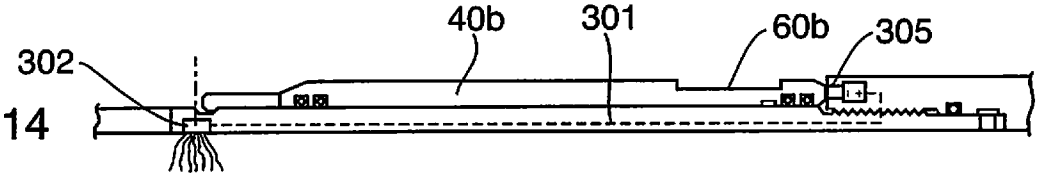
FIG. 14 shows and enlarged view of region 'Y' of FIG. 13.
Figure 15:
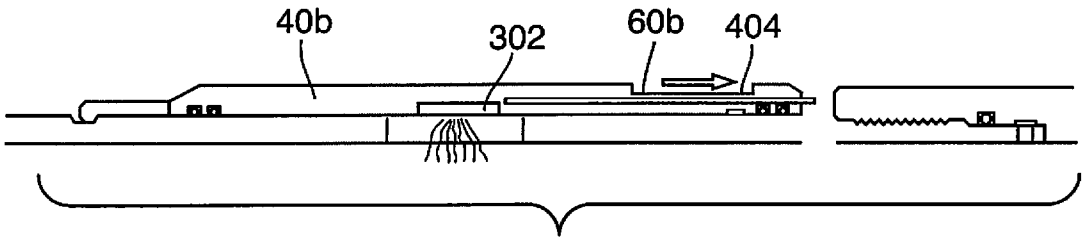
FIG. 15 shows a view similar to FIG. 14 of an alternative embodiment of the sub member of the present invention, having a percussion pin for actuating and detonating the explosive charge.

Upon a dart 20 having radially-outwardly biased member 80*b* of corresponding width to circumferential groove 60*b* engaging groove 60*b* and slidably repositioning sleeve 30*b* to a second position, as shown in FIG. 13, contact 305 closes an circuit to allow voltage to be supplied via to electrically conductive lines 301 to thereby cause detonation of charge 302, as best shown in enlarged view in FIG. 14.

Alternatively, as best shown in FIG. 15, instead of using a battery and an electrical circuit to detonate charges 302, sleeve 40*b* may contain a slidable percussion pin 404 to mechanically acutate and cause detonation of explosive charge 302. In this regard, as shown in FIG. 15, upon slidable sleeve 40*b* being moved to a second position, pin 404 is caused to contact explosive charge 302 and detonate same. In such embodiment explosive charge 302 is positioned in sleeve 40*b* to be positioned immediately beneath frac port 50*b* in sub member 300 when sleeve 40*b* is in the second position.

Figure 16A:
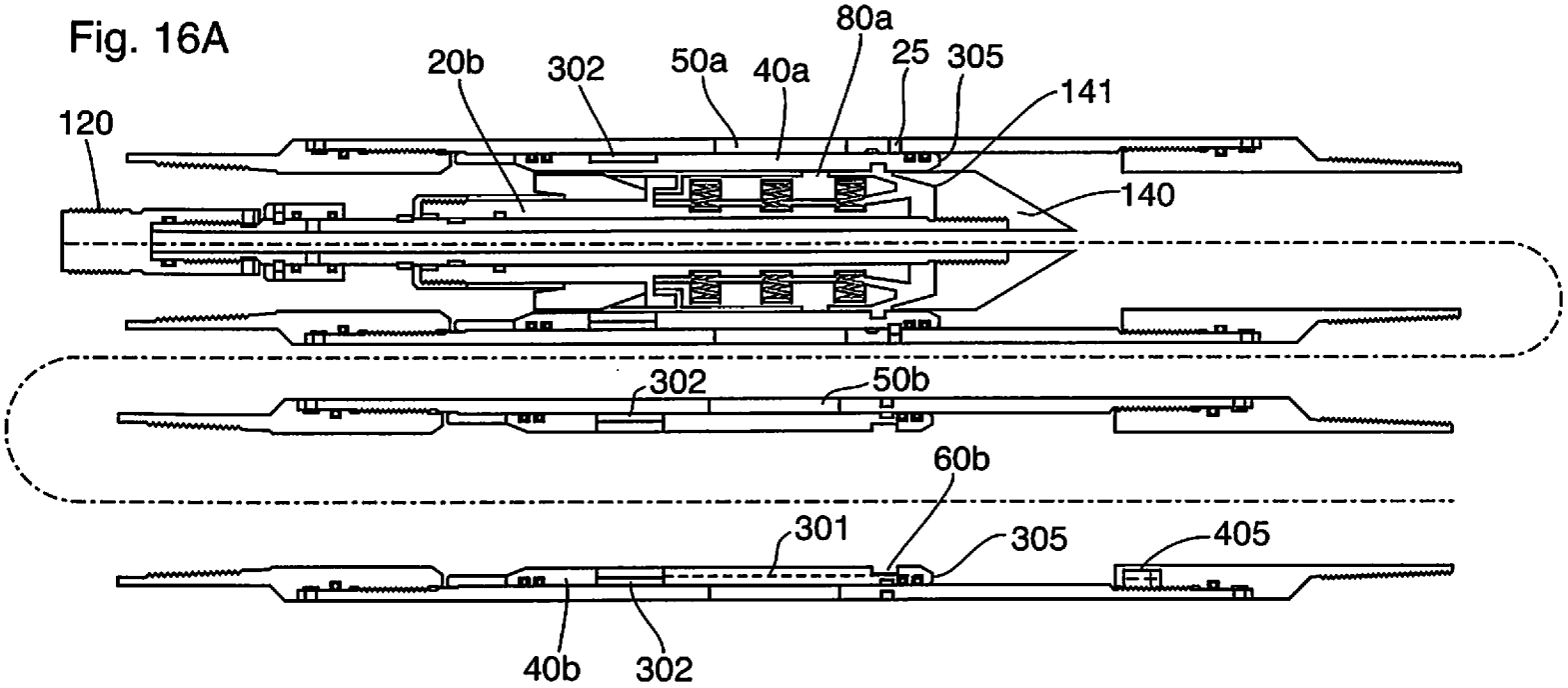
FIGS. 16A-16C show a preferred embodiment of the apparatus of the present invention for both perforating and fracing a wellbore wherein the dart is further configured to allow being being removed by a retrieval tool after perforation and fracking has been carried out.
Figure 16B:
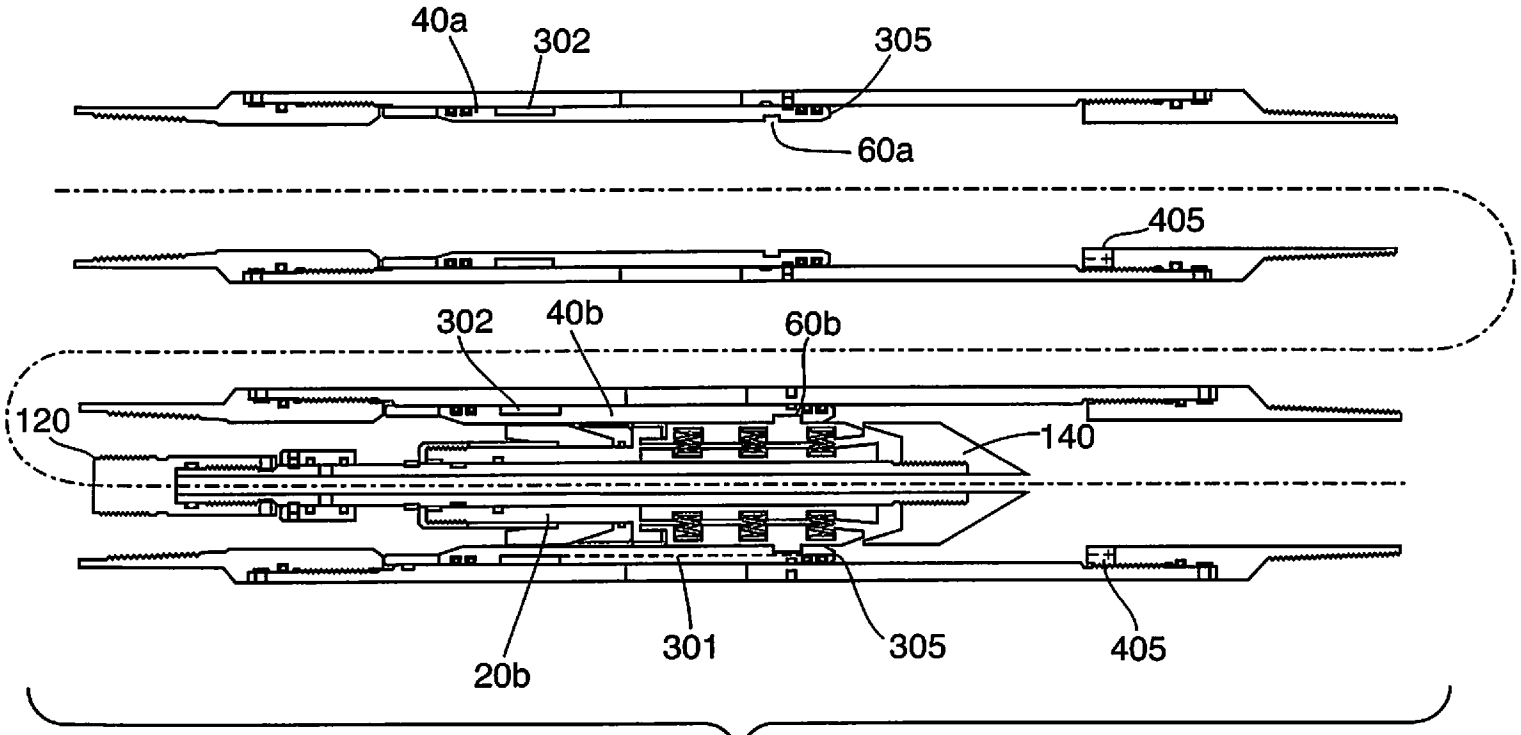
Figure 16C:
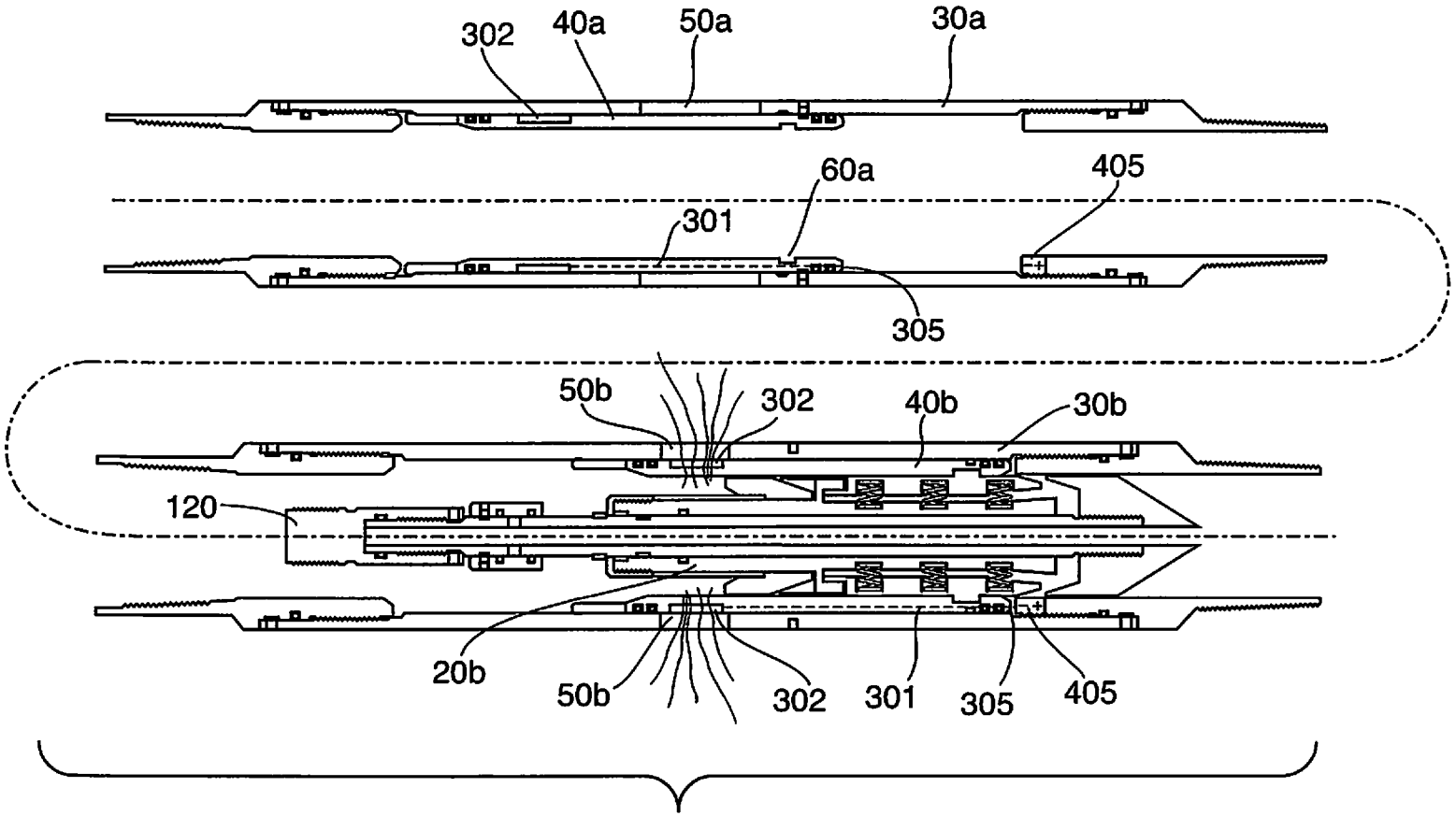

FIGS. 16A-16C show apparatus and a method for both selectively perforating and fracking a wellbore, commencing downhole and progressively moving uphole.

FIG. 16A shows a dart 20*b* moving past a sleeve 20*a* and not engaging same due to grove 60*a* in sleeve 40*a* being of a lesser width than the width of the radially-outwardly biased member 80*b* on dart 20*b*.

FIG. 16B shows dart 20*b* having moved downhole to downhole valve sub 30*b*, and radially-outwardly biased member 80*b* thereon having engaged circumferential groove 60*b* on sleeve 40*b*.

FIG. 16C shows dart 20*b* having slidably repositioned sleeve 40*b* to a second position, wherein explosive charge is positioned immediately beneath frac port 50*b*. Electrical contact 305 at the extremity of sleeve 40*b* is caused to close an electrical circuit, and voltage from battery 405 flows via electrical conductor wires 301 to explosive charge 302, thereby detonating such charge 302, fracking the wellbore at such location and ensuring fluid communication from within valve sub 30*b* through port 50*b*. Coupling means 120 is provided on dart 20*b* to allow dart 20 to be withdrawn uphole by a retrieval tool 130. In doing so, wedge-shaped member 140, and in particular frusto-conical surface 141 thereon, depresses member 80*b* from groove 60*b*, to thereby allow dart 20*b* to be withdrawn uphole.

Use of examples in the specification, including examples of terms, is for illustrative purposes only and is not intended to limit the scope and meaning of the embodiments of the invention set out and described in the disclosure. Numeric ranges are inclusive of the numbers defining the range. In the specification, the word "comprising" is used as an open-ended term, substantially equivalent to the phrase "including, but not limited to," and the word "comprises" has a corresponding meaning.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiments in which an exclusive property and privilege is claimed are set out in the following claims:

1. An apparatus for perforating a wellbore casing when inserted in a wellbore surrounded by said casing, comprising:

(i) a hollow cylindrical valve sub member for placement in said wellbore casing, having coupling means at opposite ends thereof and having an inner bore, and further having a radial frac port in a periphery thereof which when open allows egress of frac fluid from within said inner bore of said valve sub member to an exterior of said hollow cylindrical valve sub member and into a region intermediate said hollow cylindrical valve sub member and said casing of said well bore;

(ii) a hollow cylindrical slidable sleeve within said sub member, longitudinally slidable within said bore of said sub member from a first uphole position therein covering said frac port in said valve sub member to a second downhole position therein uncovering said frac port in said valve sub member so as to establish a fluid communication from said inner bore of said valve sub member via said frac port to said exterior of said hollow cylindrical valve sub member and to said region intermediate said hollow cylindrical valve sub member and said casing of said well bore;

(iii) a shear member which initially fixes said slidable sleeve to said bore and maintains said slidable sleeve in said first position;

(iv) a directional shaped explosive charge within or on a portion of an exterior of said slidable sleeve or said sub member; and (v) actuation means for actuating said directional shaped explosive charge upon slidable displacement of said slidable sleeve from said first position to said second position, wherein said actuation means for actuating said directional shaped explosive charge comprises a source of electrical energy coupled to said explosive charge via an electrical circuit which is in contact with said slidable sleeve so as to close the electrical circuit upon displacement of said slidable sleeve from said first position to said second position, or a percussion pin member on and slidable with said slidable sleeve to mechanically actuate and cause detonation of said explosive charge upon displacement of said slidable sleeve from said first position to said second position.

2. The apparatus as claimed in claim 1, further comprising:

(i) a cylindrical dart for insertion in said bore, having engaging means thereon for engaging said slidable sleeve and causing longitudinal downhole slidable movement of said slidable sleeve when fluid pressure is exerted at an uphole end of said dart.

3. The apparatus as claimed in claim 2, wherein:

(i) said engaging means on said dart comprises a radially-outwardly biased member, said slidable sleeve having a single circumferential groove in an interior surface thereof of sufficient longitudinal width for receiving therewithin said radially-outwardly biased member.

4. The apparatus as claimed in claim 1 or 3 wherein:

said dart further possesses:

(i) at an uphole end thereof latch means to permit coupling to a retrieving tool, to permit said dart to be withdrawn from said wellbore; and (ii) a longitudinally moveable wedge-shaped member on said dart positioned below said radially outwardly-biased member and configured when pulled uphole to depress radially inwardly said radially outwardly-biased member;

wherein when said retrieving tool is coupled to said dart and thus to said wedge-shaped member and said retrieving tool is withdrawn for a short distance uphole, said withdrawal longitudinally repositions said wedge-shaped member uphole which then depresses said radially-outwardly-biased member to allow disengagement thereof with said groove to thereby allow said dart to be withdrawn uphole.

5. The apparatus as claimed in claim 2, wherein:

(i) said engaging means on said dart comprises a single circumferential groove in an exterior surface thereof, said slidable sleeve having a radial-inwardly biased member, said radially-inwardly biased member of sufficient longitudinal width for receiving therewithin said radially-inwardly biased member.

6. The apparatus as claimed in claim 2, wherein said dart further possesses, at an uphole end thereof, latch means to permit coupling to a retrieving tool, to permit said dart to be withdrawn from said wellbore.

7. The apparatus as claimed in claim 6, said dart, uphole from said engaging means but downhole from said latch means, possessing a cup seal;

said dart further having a bypass port situated uphole from said cup seal to allow fluid above said cup seal to bypass said cup seal when said dart is withdrawn uphole and prevent swabbing of said wellbore when said dart is withdrawn; and said dart having a valve member sleeve covering said bypass port, which valve member sleeve is adapted to be displaced by said retrieval tool when said retrieving tool is coupled to said dart, to thereby open said bypass port.

8. The apparatus as claimed in claim 7, wherein:

said dart further possesses:

(i) a longitudinally moveable wedge-shaped member on said dart;

wherein when said retrieving tool is coupled to said dart and thus to said wedge-shaped member and said retrieving tool is withdrawn for a short distance uphole, said withdrawal longitudinally repositions said wedge-shaped member uphole which then depresses said radially-outwardly-biased member to allow disengagement thereof with said groove to thereby allow said dart to be withdrawn uphole.

9. The apparatus as claimed in claim 1, wherein:

(i) said valve sub member has at least one frac port extending therethrough proximate an uphole end thereof;

(ii) said slidable sleeve closing said at least one frac port when said sleeve is in said first uphole position and opening said frac port so as to allow said frac port to be in fluid communication with said inner bore when said slidable sleeve is longitudinally displaced to said second downhole position.

10. The apparatus as claimed in claim 9, wherein said directional shaped explosive charge is positioned on said slidable sleeve immediately beneath said frac port when said slidable sleeve is displaced to said second downhole position.

11. The apparatus as claimed in claim 10, wherein said actuation means comprises a mechanical percussion pin member within said slidable sleeve, and wherein said percussion pin member is moved when said slidable sleeve is displaced to said second position and is thereby caused to contact and ignite said shaped explosive charge on said slidable sleeve.

12. The apparatus as claimed in claim 9, wherein said directional shaped explosive charge is positioned on an exterior of said valve sub member immediately proximate said frac port thereon.

13. The apparatus as claimed in claim 1, wherein said actuation means comprises a source of electrical energy and said source of electrical energy comprises a battery for supplying an electrical voltage, and said slidable sleeve upon moving to said second downhole position is caused to contact and thus close an electrical circuit in communication with said battery to allow said voltage to be supplied to said shaped charge to detonate said shaped explosive charge.

14. A method for perforating a casing of a wellbore, comprising the steps of:

(i) inserting a hollow cylindrical sub member in said wellbore casing, said sub member having:

(a) coupling means at opposite ends thereof and an inner bore;

(b) a frac port in a periphery of said sub member, having a hollow cylindrical slidable sleeve within said sub member, longitudinally slidable within said bore of said sub member from a first uphole position therein covering said frac port in said valve sub member to a second downhole position uncovering said frac port in said valve sub member;

(c) shear means which initially fixes said slidable sleeve to said bore and maintains said slidable sleeve in said first position;

(d) a directional shaped explosive charge within or on a portion of an exterior of said slidable sleeve or said sub member; and (e) actuation means for actuating said directional shaped explosive charge upon and at the time of said slidable sleeve being displaced from said first position to said second position, wherein said actuation means for actuating said directional shaped explosive charge comprises a source of electrical energy being coupled to said explosive charge via an electrical circuit which is in contact with said slidable sleeve so as to close the electrical circuit upon said slidable member being moved from said first position to said second position, or a percussion pin member on and slidable with said slidable sleeve mechanically acutates and causes detonation of said explosive charge upon said slidable sleeve being moved from said first position to said second position;

(ii) inserting a dart in said bore of said cylindrical member, said dart having engaging means thereon for engaging said slidable sleeve and causing downhole movement of said slidable sleeve when fluid pressure is applied to said dart from said first position to said second position; and (iii) providing fluid pressure at an uphole end of said dart and causing said slidable sleeve to move from said first uphole position to said second position thereby uncovering said frac port in said sub member and establishing a fluid communication from said inner bore of said valve sub member via said frac port to said exterior of said hollow cylindrical valve sub member and to said region intermediate said hollow cylindrical valve sub member and said casing of said well bore, and further actuating said actuation means so as to:

(a) coupling said source of electrical energy to said explosive charge; or (b) moving said percussion pin member via moving said slidable member from said first position to said second position to contact said explosive charge; and detonating said directional shaped explosive charge.

15. The method as claimed in claim 14 for simultaneously perforating a casing and opening a frac port in said sub member when same is situated in said wellbore casing, said sub member further comprising:

(a) at least one frac port within said sub member situated proximate an uphole end thereof;

said method further comprising:

providing said fluid pressure at said uphole end of said dart and causing said slidable sleeve to move from said first uphole position to said second downhole position to simultaneously detonate said shaped charge and open said frac port.

* * * * *